US007874634B2

(12) United States Patent
Horii et al.

(10) Patent No.: US 7,874,634 B2
(45) Date of Patent: Jan. 25, 2011

(54) IMAGE FORMING APPARATUS AND IMAGE FORMING METHOD

(75) Inventors: Hiroyuki Horii, Kawasaki (JP); Hisashi Ishikawa, Urayasu (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 12/420,478

(22) Filed: Apr. 8, 2009

(65) Prior Publication Data

US 2009/0267982 A1 Oct. 29, 2009

(30) Foreign Application Priority Data

Apr. 25, 2008 (JP) ..... 2008-116295

(51) Int. Cl.
*B41J 2/15* (2006.01)

(52) U.S. Cl. ..... 347/15; 347/19; 347/41

(58) Field of Classification Search ..... 347/12, 347/15, 40, 43, 19, 41; 358/1.2, 1.9
See application file for complete search history.

(56) References Cited

U.S. PATENT DOCUMENTS 6,045,210 A 4/2000 Suzuki et al.
6,533,393 B1 * 3/2003 Meyer et al. ..... 347/43
6,698,861 B1 * 3/2004 Drake ..... 347/15
6,707,579 B1 3/2004 Komiya et al.
6,874,864 B1 * 4/2005 Maeda et al. ..... 347/41

FOREIGN PATENT DOCUMENTS

JP 2-286341 A 11/1990
JP 2000-52571 A 2/2000
JP 2006-218774 A 8/2006

* cited by examiner

*Primary Examiner*—Lamson D Nguyen
(74) *Attorney, Agent, or Firm*—Fitzpatrick, Cella, Harper & Scinto

(57) ABSTRACT

An image forming apparatus which forms a halftone image on a print medium (200) using multipass processing of reciprocally scanning a single area by an inkjet head (220) a plurality of number of times, forming dots in one of reciprocal scan operations, and moving the inkjet head (220) to a home position in the other reciprocal scan operation includes a print data generation unit (370) which generates print data of each print-scan operation, a printer engine (180) which prints a halftone image on the basis of the print data generated by the print data generation unit (370), and a sensor (230) which detects the state of printing in up to a print-scan operation immediately preceding a print-scan operation of interest. The print data generation unit (370) corrects print data in synchronism with printing by the printer engine (180) on the basis of the detected printing state.

11 Claims, 16 Drawing Sheets

IMAGE FORMING APPARATUS AND IMAGE FORMING METHOD

BACKGROUND OF THE INVENTION

1. Field of the Invention

The present invention relates to an image forming technique of forming an image on a print medium.

2. Description of the Related Art

As a technique of correcting density nonuniformity, Japanese Patent Laid-Open No. 02-286341 (reference 1: U.S. Pat. No. 6,045,210) discloses a technique of, when printing an image, detecting density nonuniformity of printing elements at a predetermined timing, and adjusting, based on the detection result, a driving signal to be supplied to a printhead.

Japanese Patent Laid-Open No. 2006-218774 (reference 2) discloses a technique of correcting the print medium conveyance amount on the basis of the result of comparing a test pattern and an image obtained by repeating printing of an image and intermittent conveyance of a print medium in accordance with data obtained by mixing test pattern data in image data.

However, the technique disclosed in reference 1 corrects image data when the number of print sheets reaches a predetermined value or the OFF period reaches a predetermined value. This technique cannot correct density nonuniformity suddenly occurring when forming an image. For this reason, this technique cannot correct image data in real time.

The technique disclosed in reference 2 prints while mixing a test pattern in an image to be printed, and can suppress density nonuniformity caused by a conveyance amount error. However, this technique needs to add a test pattern image to an image to be printed, which may degrade the appearance.

SUMMARY OF THE INVENTION

The present invention enables to form a higher-quality image by correcting density nonuniformity in real time.

According to one aspect of the present invention, there is provided an image forming apparatus which forms a halftone image on a print medium using multipass processing of reciprocally scanning a single area on the print medium by a printhead a plurality of number of times, forming dots on the print medium in one of reciprocal scan operations, and moving the printhead to a home position in the other reciprocal scan operation, the apparatus comprises: generator configured to generate print data of each print-scan operation; printing unit configured to print the halftone image on the print medium on the basis of the print data generated by the generator; and detector, in at least one print-scan operation out of a plurality of print-scan operations, configured to detect a state of printing on the print medium by the printing unit in up to a print-scan operation immediately preceding a print-scan operation of interest, wherein the generator corrects the print data in synchronism with printing by the printing unit on the basis of the printing state detected by the detector.

The present invention can form a higher-quality image by correcting density nonuniformity in real time.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
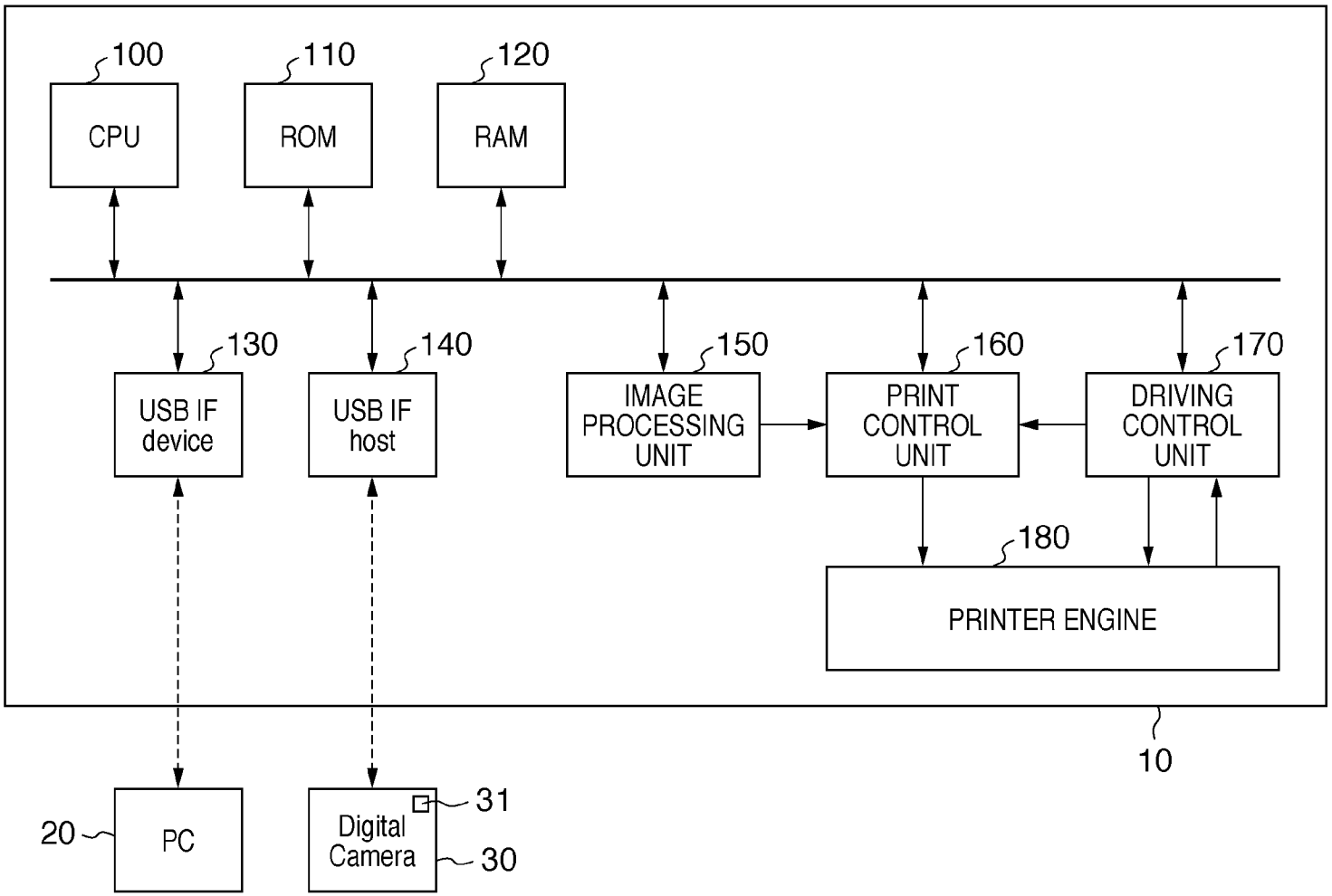
FIG. 1 is a block diagram showing the functional arrangement of a printer 10 according to the first embodiment.

A prior art and embodiments of the present invention will be explained in detail with reference to the accompanying drawings.

PRIOR ART

A known example of a conventional apparatus using a printhead having a plurality of printing elements is an inkjet printing apparatus using a printhead having a plurality of ink orifices. In the inkjet printing apparatus, the size and positions of dots formed with ink vary owing to variations in ink discharge amount, discharge direction, and the like. This leads to density nonuniformity in a printed image. Especially in a serial printing apparatus which prints by scanning an inkjet head in a plurality of directions (e.g., directions perpendicular to a print medium) different from the print medium setting direction, density nonuniformity caused by the above-mentioned variations appears and stands out as a streak in a printed image, degrading the quality of the printed image.

To correct the density nonuniformity, there has been proposed an inkjet printing method of discharging ink from different orifices to form a line of image data (dot pattern) having undergone halftone processing such as binarization processing. According to this method, 1-line image data can be complemented by a plurality of scan operations (or passes) by, for example, feeding a sheet by less than the printhead width. This method is generally called a multipass printing method.

The multipass printing method includes a method using a mask pattern, and a method of dividing the density of a multilevel input image to be printed for a plurality of scan operations and generating print data in accordance with the divided densities.

The method of performing pass division using a mask pattern divides generated print data for a plurality of print operations. For this purpose, a mask pattern corresponding to each pass is prepared in advance, and the mask pattern and generated print data are ANDed. The mask patterns are designed in advance to be able to print all generated data by a plurality of print operations. To achieve multipass division, the mask patterns are set such that printable dots are defined as 100%, printable dots are determined for each pass, dots are exclusive between passes, and the OR of printable dots in all passes equals the entire area. The mask patterns are selected to become as random as possible in order to avoid interference with halftone processing.

The present inventors have proposed a method of executing pass division by dividing the density of an input image to be printed in accordance with scanning. According to this method, the print density ratio of an input image to be printed is determined in correspondence with each scan operation. The density of an input image to be printed is divided at a division ratio determined in accordance with the print density ratio of each scan operation. The resultant image undergoes halftone processing, generating print data. In both the mask pattern method and density division method, an input image to be printed is divided for a plurality of scan operations, and then printed. The operation of multipass printing will be explained.

FIGS. 17A to 17D are views showing conventional multipass printing. FIGS. 17A to 17D exemplify four-pass printing of forming an image on a print medium 310 by scanning an inkjet head four times.

An inkjet head 300 is divided into four areas 300*a*, 300*b*, 300*c*, and 300*d*. In each area, a plurality of nozzles is arranged in the longitudinal direction. The area 300*a* is the bottom area of the inkjet head 300, and the area 300*b* is adjacent to the upper side of the area 300*a*. The area 300*c* is adjacent to the upper side of the area 300*b*, and the area 300*d* is adjacent to the upper side of the area 300*c*. As described above, the areas 300*a* to 300*d* are formed by equally dividing the area of the inkjet head 300 into four.

The printer repeats printing by moving the print medium 310 up with respect to the inkjet head 300 by a paper feed mechanism after the inkjet head 300 scans the print medium 310.

Figure 17A:
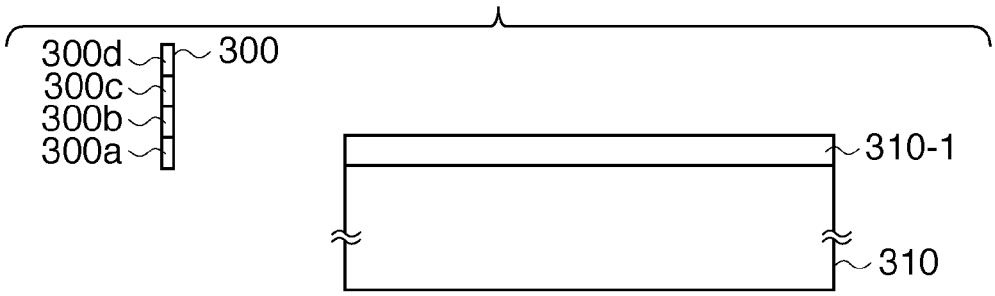
FIGS. 17A to 17D are views showing conventional multipass printing.

FIG. 17A shows scanning of an area 310-1 in the first pass. First, print data to be printed in the first pass out of print data to be printed in the area 310-1 of the print medium 310 is transmitted to the area 300*a* that is a lower ¼ area of the inkjet head 300. Then, the area 300*a* of the inkjet head 300 scans left (or right) the print medium 310. Printing in the first pass is done in the area 310-1 of the print medium 310 using nozzles arranged in the area 300*a*. In printing in the first pass, neither print data is transmitted to nozzles arranged in the areas 300*b*, 300*c*, and 300*d* of the inkjet head 300, nor printing is done in corresponding areas of the print medium 310.

After the end of the print processing, the print medium 310 is fed by a ¼ length (i.e., the width of the area 300*a* in the nozzle array direction) of the inkjet head 300.

Figure 17B:
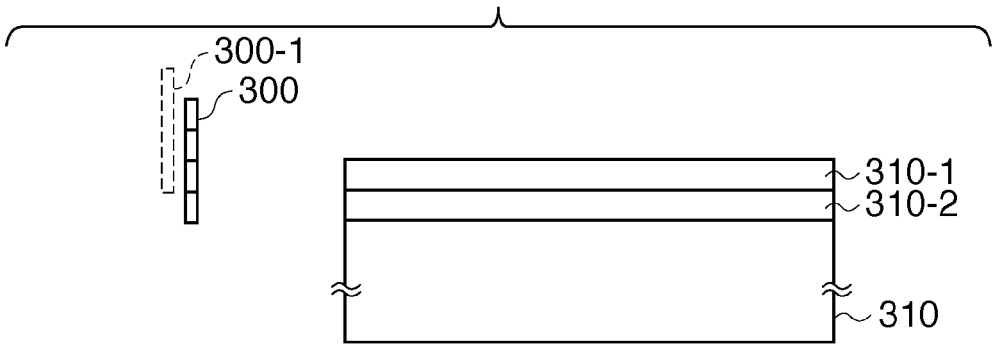

FIG. 17B shows scanning of the area 310-1 in the second pass. In scanning of the area 310-1 in the second pass, the inkjet head 300 resides at a position indicated by a solid line with respect to the print medium 310. In scanning in the first pass immediately preceding the second pass, the inkjet head 300 resided at a position 300-1 indicated by a broken line with respect to the print medium 310.

First, print data to be printed in the first pass out of print data to be printed in an area 310-2 of the print medium 310 is transmitted to the area 300*a* of the inkjet head 300. Then, the area 300*a* of the inkjet head 300 scans left (or right) the area 310-2 of the print medium 310. Printing in the first pass is done in the area 310-2 of the print medium 310 using nozzles arranged in the area 300*a*.

Also, print data to be printed in the second pass out of print data to be printed in the area 310-1 of the print medium 310 is transmitted to the area 300*b* of the inkjet head 300. The area 300*b* of the inkjet head 300 scans left (or right) the area 310-1 of the print medium 310. Printing in the second pass is done in the area 310-1 of the print medium 310 using nozzles arranged in the area 300*b*. Since the areas 300*c* and 300*d* of the inkjet head 300 have not reached the print area yet, neither print data is transmitted, nor printing is done in corresponding areas of the print medium 310.

After the end of the print processing, the print medium 310 is fed by a ¼ length (i.e., the width of the area 300*a* in the nozzle array direction) of the inkjet head 300.

Figure 17C:
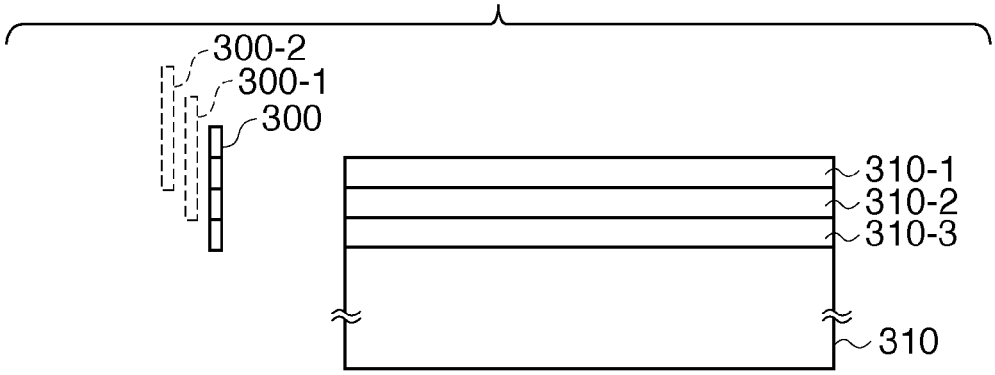

FIG. 17C shows scanning of the area 310-1 in the third pass. In scanning of the area 310-1 in the third pass, the inkjet head 300 resides at a position indicated by a solid line with respect to the print medium 310. In scanning in the second pass immediately preceding the third pass, the inkjet head 300 resided at the position 300-1 indicated by a broken line with respect to the print medium 310. In scanning in the first pass preceding the third pass by two, the inkjet head 300 resided at a position 300-2 indicated by a broken line with respect to the print medium 310.

First, print data to be printed in the first pass out of print data to be printed in an area 310-3 of the print medium 310 is transmitted to the area 300*a* of the inkjet head 300. Then, the area 300*a* of the inkjet head 300 scans left (or right) the area 310-3 of the print medium 310. Printing in the first pass is done in the area 310-3 of the print medium 310 using nozzles arranged in the area 300*a*.

Also, print data to be printed in the second pass out of print data to be printed in the area 310-2 of the print medium 310 is transmitted to the area 300*b* of the inkjet head 300. The area 300*b* of the inkjet head 300 scans left (or right) the area 310-2 of the print medium 310. Printing in the second pass is done in the area 310-2 of the print medium 310 using nozzles arranged in the area 300*b*.

Further, print data to be printed in the third pass out of print data to be printed in the area 310-1 of the print medium 310 is transmitted to the area 300*c* of the inkjet head 300. The area 300*c* of the inkjet head 300 scans left (or right) the area 310-1 of the print medium 310. Printing in the third pass is done in the area 310-1 of the print medium 310 using nozzles arranged in the area 300*c*. Since the area 300*d* of the inkjet head 300 has not reached the print area yet, neither print data is transmitted, nor printing is done in a corresponding area of the print medium 310.

After the end of the print processing, the print medium 310 is fed by a ¼ length (i.e., the width of the area 300*a* in the nozzle array direction) of the inkjet head 300.

Figure 17D:
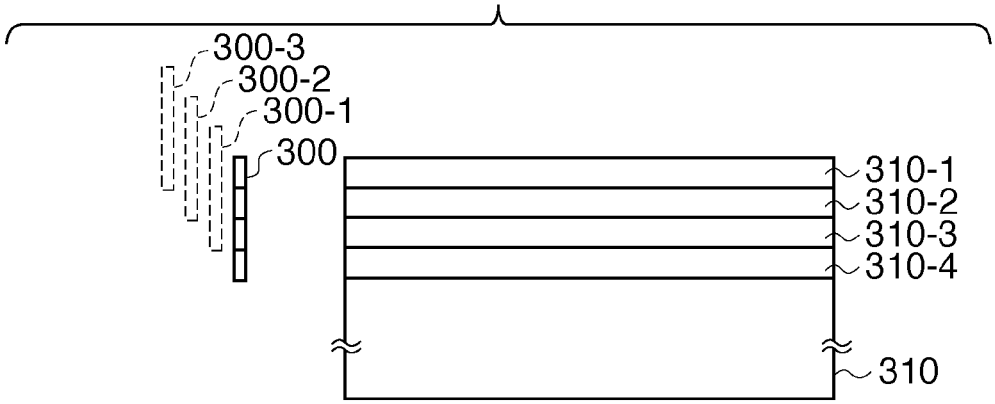

FIG. 17D shows scanning of the area 310-1 in the fourth pass. In scanning of the area 310-1 in the fourth pass, the inkjet head 300 resides at a position indicated by a solid line with respect to the print medium 310. In scanning in the third pass immediately preceding the fourth pass, the inkjet head 300 resided at the position 300-1 indicated by a broken line with respect to the print medium 310. In scanning in the second pass preceding the fourth pass by two, the inkjet head 300 resided at the position 300-2 indicated by a broken line with respect to the print medium 310. In scanning in the first pass preceding the fourth pass by three, the inkjet head 300 resided at a position 300-3 indicated by a broken line with respect to the print medium 310.

First, print data to be printed in the first pass out of print data to be printed in an area 310-4 of the print medium 310 is transmitted to the area 300*a* of the inkjet head 300. Then, the area 300*a* of the inkjet head 300 scans left (or right) the area 310-4 of the print medium 310. Printing in the first pass is done in the area 310-4 of the print medium 310 using nozzles arranged in the area 300*a*.

Also, print data to be printed in the second pass out of print data to be printed in the area 310-3 of the print medium 310 is transmitted to the area 300*b* of the inkjet head 300. The area 300*b* of the inkjet head 300 scans left (or right) the area 310-3 of the print medium 310. Printing in the second pass is done in the area 310-3 of the print medium 310 using nozzles arranged in the area 300*b*.

Print data to be printed in the third pass out of print data to be printed in the area 310-2 of the print medium 310 is transmitted to the area 300*c* of the inkjet head 300. The area 300*c* of the inkjet head 300 scans left (or right) the area 310-2 of the print medium 310. Printing in the third pass is done in the area 310-2 of the print medium 310 using nozzles arranged in the area 300*c*.

Further, print data to be printed in the fourth pass out of print data to be printed in the area 310-1 of the print medium 310 is transmitted to the area 300*d* of the inkjet head 300. The area 300*d* of the inkjet head 300 scans left (or right) the area 310-1 of the print medium 310. Printing in the fourth pass is done in the area 310-1 of the print medium 310 using nozzles arranged in the area 300*d*.

After the end of the print processing, the areas 300*a*, 300*b*, 300*c*, and 300*d* of the inkjet head 300 have executed print processes in the first, second, third, and fourth passes, completing the entire image formation in the area 310-1.

After the end of scanning the area 310-1 in the fourth pass, the print medium 310 is fed by a ¼ length (i.e., the width of the area 300*a* in the nozzle array direction) of the inkjet head 300. Then, printing by scanning the inkjet head 300, and paper feed are sequentially repeated to form an image on the print medium 310.

In this way, the conventional multipass printing method divides the area on a print medium for a plurality of scan operations, divides print data for the respective scan operations, and prints the divided print data, in order to reduce density nonuniformity such as a streak arising from the paper feed error of the driving unit or variations in the nozzles of the inkjet head.

Multipass printing can reduce, to a certain degree, density nonuniformity such as a streak arising from variations in the conveyance amount of the print medium 310 by the driving unit or variations in the nozzles of the inkjet head (e.g., variations (deviations) in discharge amount or discharge direction). However, amid a growing demand for higher print quality, the print droplet size is decreasing and the print resolution is increasing. It is difficult to solve the above-described problems of the printer and suppress density nonuniformity by only the conventional multipass printing method.

Figure 14:
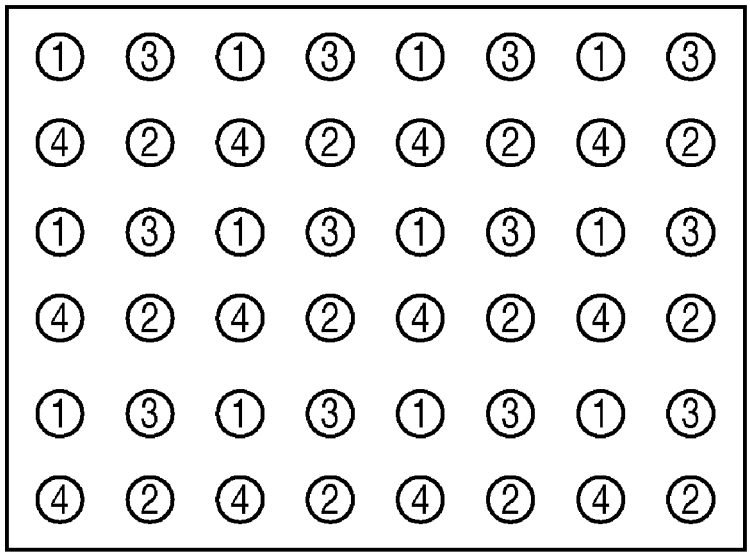
FIG. 14 is a view showing the positions of dots formed in respective passes in the prior art and the second modification to the first embodiment.
Figure 15:
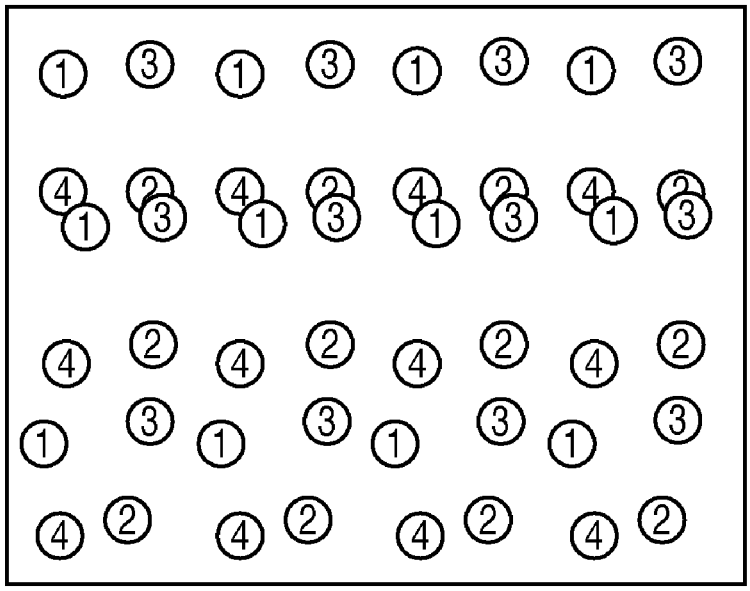
FIG. 15 is a view showing the positions of dots formed in respective passes in the prior art.

FIGS. 14 and 15 are views showing the positions of dots formed in respective passes in a prior art. Generation of density nonuniformity such as a streak owing to variations in the conveyance amount of a print medium by the driving unit or variations in the nozzle characteristics (e.g., variations (deviations) in discharge amount or discharge direction) of the inkjet head will be explained. Note that dot positions are slightly different from those in actual printing in order to clearly explain density nonuniformity caused by variations in the conveyance amount of a print medium by the driving unit or variations in the nozzle characteristics (e.g., variations in discharge amount or discharge direction) of the inkjet head.

FIG. 14 shows dots discharged at ideal positions in 4-pass printing at a given density. ○ represents a printed dot, and a numeral in ○ represents the pass number of one of the first to fourth passes in which the dot is printed. Assume that the division coefficients of the respective passes are 0.25 so that the print ratios of the respective passes become equal to each other. To clarify density nonuniformity, odd-numbered lines out of print lines are printed in the first and third passes, and even-numbered lines are printed in the second and fourth passes, which is different from actual printing. When the discharge characteristics of the inkjet head do not vary (e.g., no variation in discharge amount and discharge direction), and the conveyance amount of a print medium by the driving unit of the printer does not vary, printed dots are arrayed in a matrix to form an image at a uniform density, as shown in FIG. 14.

However, when an image quality degradation factor such as variations in the discharge characteristics of the inkjet head or variations in the conveyance amount of a print medium exists, the ink dot layout or the like deviates from an ideal state, as shown in FIG. 15, and the density of a formed image becomes nonuniform. In FIG. 15, the print medium conveyance amount after printing in the first pass and that after printing in the third pass are slightly large, the print medium conveyance amount after printing in the second pass is slightly small, and in addition, the discharge direction varies. As a result, dots, which should be arranged ideally uniformly as shown in FIG. 14, come close to each other between the second and third lines, and are separated from each other between the first and second lines and between the third and fourth lines. At these portions, density nonuniformity appears. The present invention can employ the following embodiments to suppress this density nonuniformity.

First Embodiment

FIG. 1 is a block diagram showing the functional arrangement of a printer 10 according to the first embodiment.

In the first embodiment, the printer 10 is an inkjet printer. The printer 10 includes a CPU (Central Processing Unit) 100, ROM 110, RAM 120, USB device interface (I/F) 130, and USB host interface (I/F) 140. The printer 10 also includes an image processing unit 150, print control unit 160, driving control unit 170, and printer engine 180.

The CPU 100 controls the printer 10. The ROM 110 stores programs and table data for the CPU 100. The RAM 120 is a memory for storing variables and data.

The USB device interface 130 receives data from a personal computer (PC) 20. The USB host interface 140 receives data from an electronic device such as a digital camera 30. In the first embodiment, the personal computer 20 is connected to the USB device interface 130 while the digital camera 30 is connected to the USB host interface 140.

The image processing unit 150 performs processes such as color conversion and binarization for a multilevel image input from an electronic device such as the digital camera 30. The print control unit 160 executes print control by transmitting print data having undergone binarization processing by the image processing unit 150 to the printer engine 180. The printer engine 180 has an inkjet head, paper feed mechanism, carriage feed mechanism, and the like. The printer engine 180 prints a halftone image on a print medium 200 on the basis of a control signal from the print control unit 160. The driving control unit 170 controls the driving unit (e.g., the rotational speed of the motor) of the printer engine 180 such as the paper feed mechanism and carriage feed mechanism.

Assume that an image sensed by the digital camera 30 is to be directly transmitted to the printer 10 and printed without the mediacy of the personal computer 20. First, a sensor (not shown) for detecting the type of print medium reads information of a print medium (not shown) set in the printer engine 180. Then, the CPU 100 determines the type of print medium. A variety of sensors for detecting the type of print medium have been proposed. An example of such a sensor emits light of a specific wavelength to a print medium, and reads the reflected light. The sensor compares the reflected light with a plurality of wavelength samples stored in advance, thereby determining the print medium.

Image data sensed by the digital camera 30 is stored as a JPEG image in an internal memory 31 of the digital camera 30. The digital camera 30 is connected to the USB host interface 140 of the printer 10 via a connection cable. The sensed image stored in the memory 31 of the digital camera 30 is temporarily stored in the RAM 120 of the printer 10 via the USB host interface 140. The image data received from the digital camera 30 is a JPEG image. The compressed image is decompressed into image data using the CPU 100, and the image data is stored in the RAM 120. Based on the image data stored in the RAM 120, print data to be printed by the inkjet head of the printer engine 180 is generated. The image processing unit 150 executes color conversion processing, binarization processing, and the like for the image data stored in the RAM 120, converting the image data into print data (dot data). Further, pass division is executed to make the print data cope with multipass printing. Details of the processing sequence in the image processing unit 150 will be described later.

The pass-divided print data are transmitted to the print control unit 160, and then transmitted to the inkjet head of the printer engine 180 in the inkjet head driving order. The print control unit 160 generates discharge pulses in synchronism with the driving control unit 170 and printer engine 180. Ink droplets are discharged, forming an image on a print medium (not shown).

In the first embodiment, the image processing unit 150 performs binarization processing. However, the processing is not limited to binarization as long as tone reduction can be achieved to print an input image. For example, the processing includes N-ary (N is an integer of 2 or more) processing for data amount reduction in a case wherein the number of ink densities, ink droplet sizes, or the like is not two but three.

In the first embodiment, the sensor (not shown) arranged in the printer engine 180 detects the presence/absence of a print medium set in the printer 10, and the CPU 100 determines the type of print medium on the basis of the information detected by the sensor. Alternatively, the user may also select the type of print medium by manipulating the printer 10 or digital camera 30.

Figure 2A:
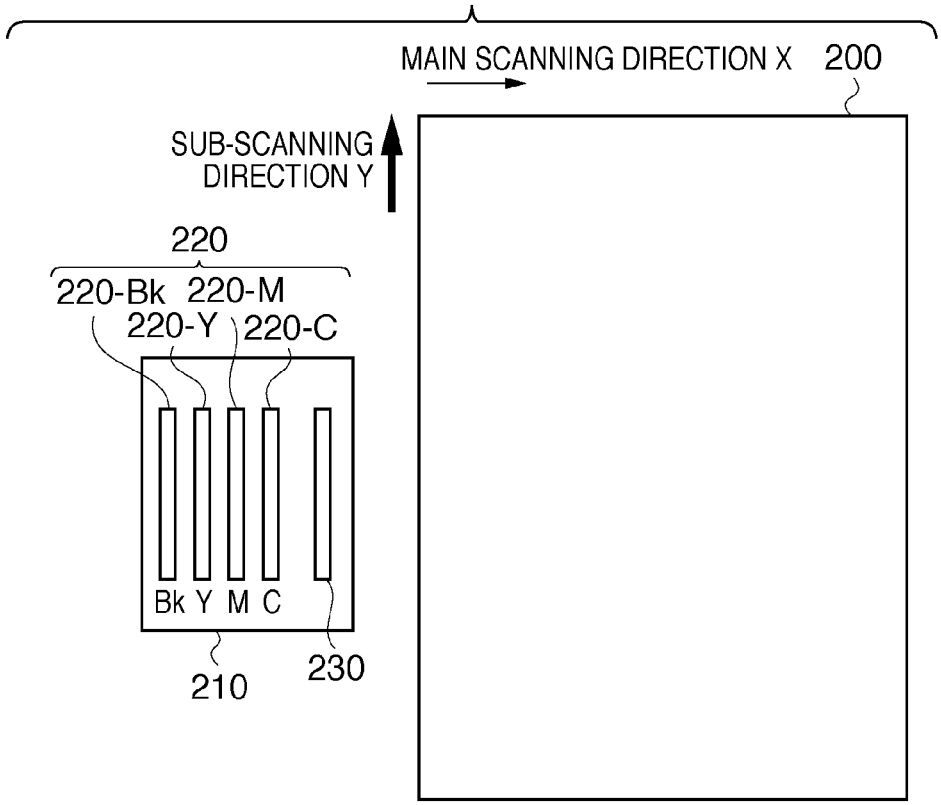
FIGS. 2A to 2C are views showing the arrangement of a print medium 200 and carriage 210.
Figure 2B:
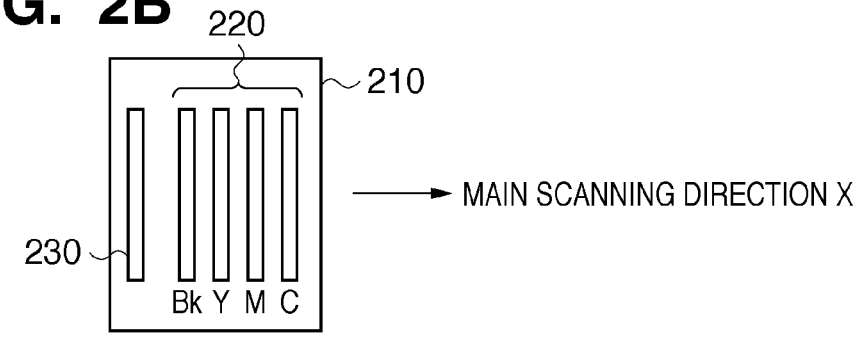
Figure 2C:
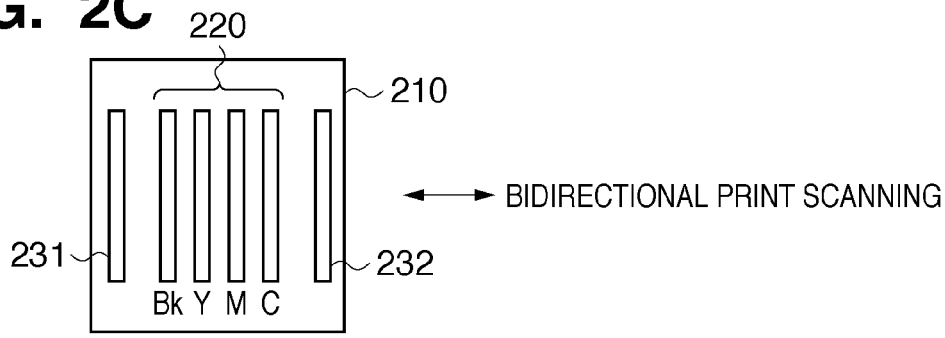

FIGS. 2A to 2C are views showing the arrangement of the print medium 200 and a carriage 210.

As shown in FIG. 2A, the carriage 210 supports an inkjet head 220 and sensor 230, and can scan both right and left. The inkjet head 220 includes four color heads: a cyan head 220*c*, magenta head 220*m*, yellow head 220*y*, and black head 220*bk*. The inkjet head 220 includes a plurality of nozzles for each color. The sensor 230 is a color sensor which detects an RGB printing state on the print medium 200. The sensor 230 is arranged adjacent to a position preceding the inkjet head 220 in a direction (main scanning direction X) in which the print-scan operation is performed. In other words, the sensor 230 moves in synchronism with the inkjet head 220. In the first embodiment, the sensor 230 is a color sensor which detects an RGB printing state. Instead, a CMY complementary color sensor, monochrome sensor, or the like is also available.

The carriage 210 prints by discharging ink droplets from the nozzles of the color inkjet head 220 when scanning the print medium 200 in the main scanning direction X. When printing by one scanning ends, the printer engine 180 (see FIG. 1) conveys the print medium 200 in the sub-scanning direction Y and sets it at the next scan position.

The first embodiment executes multipass printing to print by scanning a print area a plurality of number of times. For this reason, the amount of print medium 200 conveyed at a time is smaller than the nozzle width of the inkjet head 220. In the first embodiment, the print medium 200 is conveyed by a ¼ nozzle width of the inkjet head 220 every scanning of the carriage 210.

As shown in FIG. 2A, when the main scanning direction X (direction in which the print-scan operation is performed) is the right in the drawing, the sensor 230 resides at a position preceding the inkjet head 220. In multipass printing, the sensor 230 can detect the printing state of up to a print-scan operation (i.e., (n−1)th pass) immediately preceding a print-scan operation of interest (nth pass) during scanning. The printing state is the state of actual printing on the print medium 200 that changes depending on the discharge characteristics (variations in ink discharge amount and discharge direction) of the inkjet head 220 and variations in the conveyance amount of the print medium 200 by the printer engine 180 (see FIG. 1). Thus, density nonuniformity can be corrected in real time during scanning of the carriage 210 on the basis of the detection result of the sensor 230, details of which will be described later in the first embodiment.

As shown in FIG. 2B, when the main scanning direction X (direction in which the print-scan operation is performed) is the right in the drawing, the sensor 230 can also be arranged at a position subsequent to the inkjet head 220 in the main scanning direction X. In this case, in print data generation for a pass of interest (nth pass), the printing state of up to the (n−1)th pass cannot be detected. Instead, the printing state of up to the nth pass is detected. For this reason, density nonuniformity is corrected not in real time during scanning, but by holding an output from the sensor 230 for one scanning, details of which will be described in the fourth embodiment.

When performing formation processing on a print medium in both the forward and return passes of a reciprocal scan operation, sensors 230 may also be arranged at both positions preceding and subsequent to the inkjet head 220 in a direction in which the print-scan operation is performed, as shown in FIG. 2C. The sensor 230 arranged on the left side (the above-mentioned subsequent position) of the inkjet head 220 will be referred to as a sensor 231, and the sensor 230 arranged on the right side (the above-mentioned preceding position) of the inkjet head 220 will be referred to as a sensor 232. In this case, in scanning when the main scanning direction X is to the right, the sensor 231 detects a printing state. In scanning when the main scanning direction X is to the left, the sensor 232 detects a printing state. In bidirectional printing, the same control can be executed regardless of whether the scan direction is to the right or left.

Figure 3:
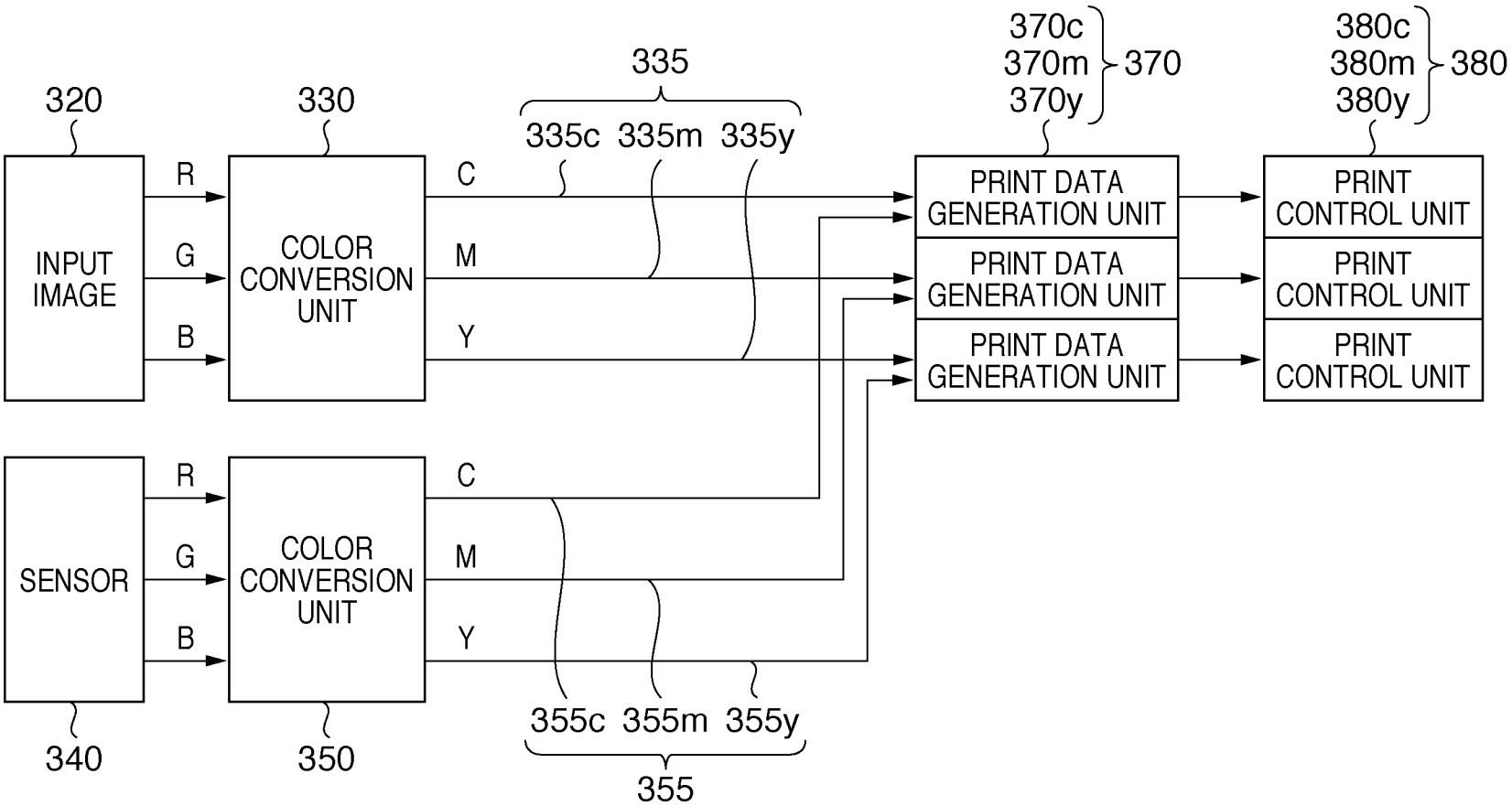
FIG. 3 is a block diagram showing the functional arrangement of an image forming apparatus according to the first embodiment.

FIG. 3 is a block diagram showing the functional arrangement of the image forming apparatus according to the first embodiment. The image forming apparatus reciprocally scans a single area on the print medium 200 by the inkjet head 220 a plurality of number of times. The image forming apparatus forms a halftone image on the print medium 200 by using multipass printing of forming dots on the print medium 200 in one of reciprocal scan operations, and moving the inkjet head 220 to a home position in the other reciprocal scan operation.

A color conversion unit 330 converts an input image 320 from R, G, and B signals into C, M, and Y signals 335 including a cyan signal 335*c*, magenta signal 335*m*, and yellow signal 335*y* for printing by the printer 10 (see FIG. 1). R, G, and B signals detected by a sensor 340 for detecting a printing state are converted by a color conversion unit 350 into C, M, and Y signals 355 including a cyan signal 355*c*, magenta signal 355*m*, and yellow signal 355*y*. The color conversion unit 350 executes color conversion into the C, M, and Y signals 355 on the basis of the color filter characteristics of the sensor 340 with respect to R, G, and B signals, the characteristic of a light source with respect to the detection area of the sensor 340, the characteristics of print inks, and the like.

A cyan print data generation unit 370*c*, magenta print data generation unit 370*m*, and yellow print data generation unit 370*y* of a print data generation unit 370 receive the C, M, and Y signals 335 converted by the color conversion unit 330 and the C, M, and Y signals 355 converted by the color conversion unit 350. The print data generation unit 370 corrects print data in synchronism with printing by the printer engine 180 on the basis of a printing state detected by the sensor 230.

The print data generation unit 370 generates print data for each print-scan operation by binarization for printing by the inkjet head. After generating the print data for the inkjet head, the print data generation unit 370 inputs them to a cyan print control unit 380*c*, magenta print control unit 380*m*, and yellow print control unit 380*y* of a print control unit 380 for the respective colors. Based on the tone-reduced print data, the print control unit 380 performs print control for the printer engine 180 (see FIG. 1) including the inkjet head, thereby forming an image on a print medium.

Figure 4:
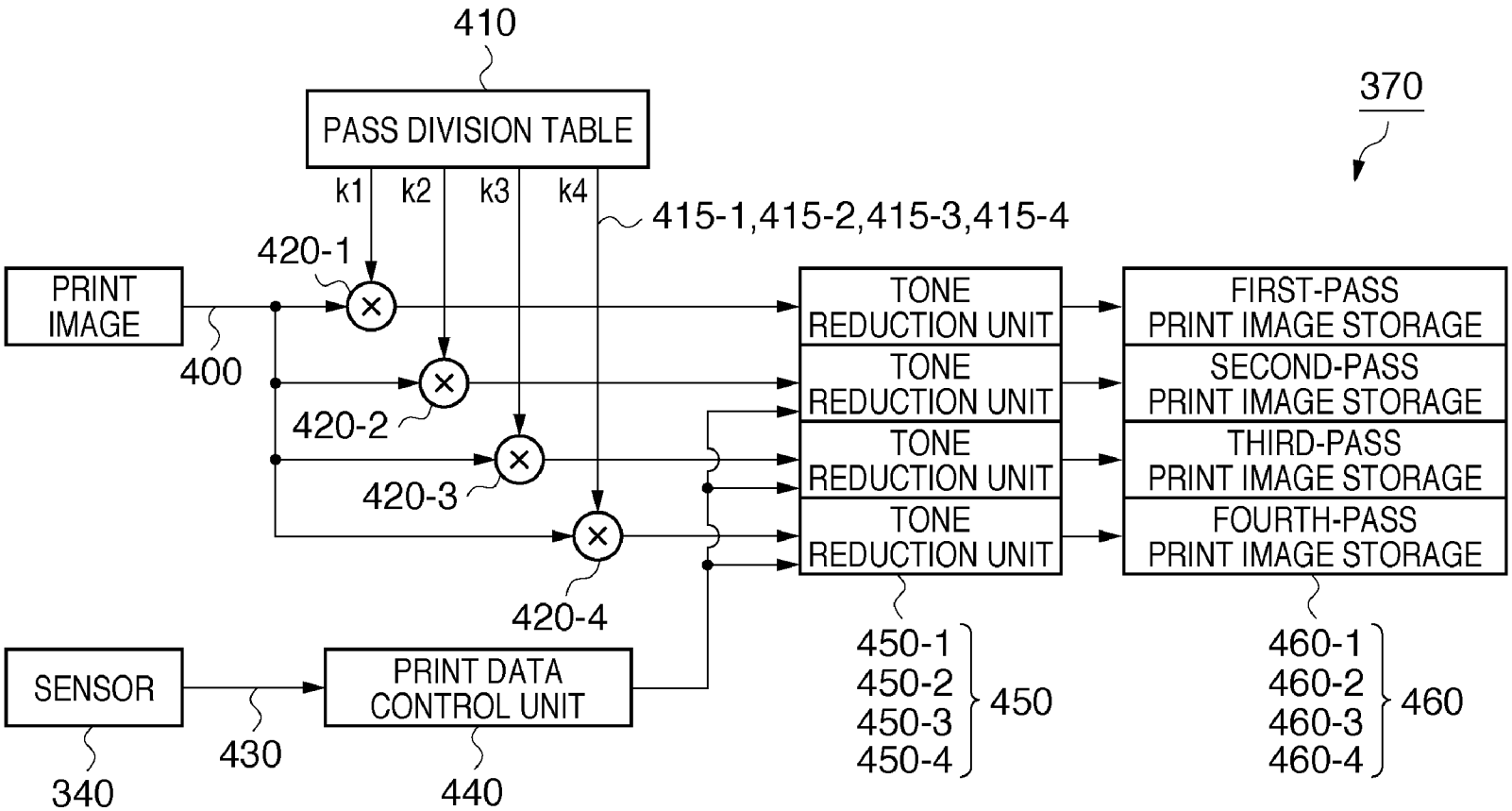
FIG. 4 is a block diagram showing the functional arrangement of a print data generation unit 370 according to the first embodiment.

FIG. 4 is a block diagram showing the functional arrangement of the print data generation unit 370 according to the first embodiment. FIG. 4 exemplifies the functional arrangement of one of the cyan print data generation unit 370*c*, magenta print data generation unit 370*m*, and yellow print data generation unit 370*y* in the print data generation unit 370 shown in FIG. 3. The color conversion unit 330 (see FIG. 3) converts a print image signal 400 (corresponding to the C, M, or Y signal 335 in FIG. 3) into each ink color for printing.

A pass division table 410 stores division ratios k1, k2, k3, and k4 for multipass division. A multiplier 420-1 calculates the print density of the first pass by multiplying the print image signal 400 by a division ratio k1 415-1 of the first pass. A multiplier 420-2 calculates the print density of the second pass by multiplying the print image signal 400 by a division ratio k2 415-2 of the second pass. A multiplier 420-3 calculates the print density of the third pass by multiplying the print image signal 400 by a division ratio k3 415-3 of the third pass. A multiplier 420-4 calculates the print density of the fourth pass by multiplying the print image signal 400 by a division ratio k4 415-4 of the fourth pass.

A signal 430 is input from the sensor 340 to a print data control unit 440. As shown in FIG. 3, the signal 430 is obtained by converting an R, G, or B signal detected by the sensor 340 into the C, M, or Y signal 355 by the color conversion unit 350. The print data control unit 440 generates control data used in density level correction and print data generation for the signal 430 from the sensor 340 that has been converted into a C, M, or Y signal. The print data control unit 440 transmits the signal to tone reduction units 450-1 to 450-4 corresponding to the respective colors.

The tone reduction unit 450-1 generates print data of the first pass from an output from the multiplier 420-1 which has calculated the print density of the first pass. Under the control of the print data control unit 440 which has generated control data for print data generation from a detection signal from the sensor 340, the tone reduction unit 450-2 generates print data of the second pass from an output from the multiplier 420-2 which has calculated the print density of the second pass. Under the control of the print data control unit 440 which has generated control data for print data generation from a detection signal from the sensor 340, the tone reduction unit 450-3 generates print data of the third pass from an output from the multiplier 420-3 which has calculated the print density of the third pass. Under the control of the print data control unit 440 which has generated control data for print data generation from a detection signal from the sensor 340, the tone reduction unit 450-4 generates print data of the fourth pass from an output from the multiplier 420-4 which has calculated the print density of the fourth pass.

A first-pass print image storage 460-1 temporarily stores, as a print image of the first pass, an output from the tone reduction unit 450-1 which has generated print data of the first pass. A second-pass print image storage 460-2 temporarily stores, as a print image of the second pass, an output from the tone reduction unit 450-2 which has generated print data of the second pass. A third-pass print image storage 460-3 temporarily stores, as a print image of the third pass, an output from the tone reduction unit 450-3 which has generated print data of the third pass. A fourth-pass print image storage 460-4 temporarily stores, as a print image of the fourth pass, an output from the tone reduction unit 450-4 which has generated print data of the fourth pass.

FIG. 4 exemplifies an arrangement for 4-pass printing. The print density of each pass is determined in accordance with the pass division table 410. The division ratios k1, k2, k3, and k4 satisfy $0 \leqq ki \leqq 1$ (i=1, 2, 3, 4), and $k1+k2+k3+k4=1$. In 4-pass printing, the division ratios k1, k2, k3, and k4 can be set to, for example, 0.25 so as to equally divide the print density for all the passes. It is also possible to set k1=0.1, k2=0.2, k3=0.3, and k4=0.4 so as to set the print ratio of the first pass slightly low and those of the passes subsequent to the first pass slightly high. In this manner, division ratios assuming various situations can be stored in the pass division table 410 to implement pass division at an arbitrary density ratio.

Print signals converted into the respective ink colors are input to the multipliers 420-1, 420-2, 420-3, and 420-4, and multiplied by the division ratios k1, k2, k3, and k4 read out from the pass division table 410, determining the print densities of the respective passes. A sequence to generate print data of each pass will be explained.

When generating print data to be printed in the area of the first pass, the multiplier 420-1 multiplies, by the division ratio k1 stored in the pass division table 410, the print image signal 400 which has been separated into each ink color by the color conversion unit 330 (see FIG. 3), thereby determining the print density of the first pass. Then, the first-pass tone reduction unit 450-1 generates print data of the first pass by reducing the print density of the first pass. The first-pass print image storage 460-1 stores the generated print data of the first pass as a print image of the first pass.

When generating print data to be printed in the area of the second pass, the multiplier 420-2 multiplies the print image signal 400 of each color by the division ratio k2 received from the pass division table 410, thereby determining the print density of the second pass. At the same time, the sensor 340 detects the printing state of the first pass. Based on the signal 430 obtained by converting the detection signal into a C, M, or Y signal by the color conversion unit 350 (see FIG. 3), the print data control unit 440 generates control data having undergone density level correction and tone reduction. Based on the control data, the second-pass tone reduction unit 450-2 reduces the print density of the second pass.

That is, unlike the conventional method of simply generating print data of the second pass, the sensor 340 detects the state of printing (printing in the first pass) by previous carriage scanning in multipass printing. Based on the detected printing state, print data generation (e.g., dot generation and dot layout) by the tone reduction unit 450-2 is controlled. The second-pass print image storage 460-2 stores the generated print data of the second pass as a print image of the second pass. Print data to be printed in the areas of the third and fourth passes can also be generated similarly to generating print data to be printed in the area of the second pass.

Figure 5:
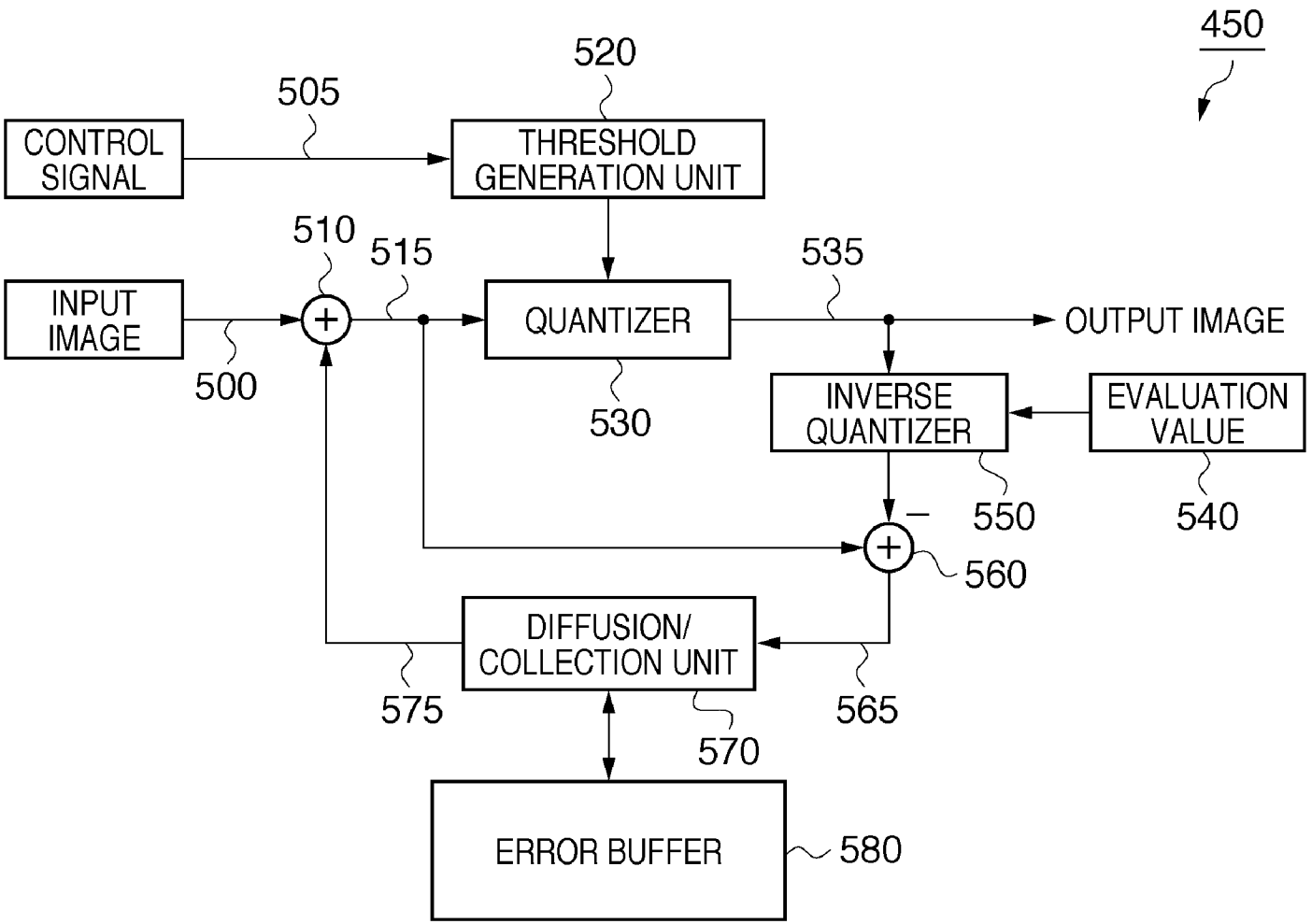
FIG. 5 is a block diagram showing the functional arrangement of a tone reduction unit 450 according to the first embodiment.

FIG. 5 is a block diagram showing the functional arrangement of the tone reduction units 450-1 to 450-4 (to be simply referred to as a tone reduction unit 450 hereinafter) according to the first embodiment. In the first embodiment, the tone reduction unit 450 executes tone reduction using an error diffusion method.

An input image signal 500 corresponds to an output signal from the multiplier 420 shown in FIG. 4. A control signal 505 corresponds to an output signal from the print data control unit 440 shown in FIG. 4, and controls the tone reduction unit 450.

An adder 510 adds an error signal 575 representing a quantization error to the input image signal 500, and outputs a quantization error-added signal 515. Based on the input control signal 505, a threshold generation unit 520 generates a threshold for performing quantization, and outputs the generated threshold to a quantizer 530. The quantizer 530 quantizes the error-containing input image signal 515 on the basis of the threshold input from the threshold generation unit 520, achieving tone reduction. Then, the quantizer 530 outputs an output signal 535.

An inverse quantizer 550 inversely quantizes the tone-reduced output signal 535 on the basis of an evaluation value 540. An adder 560 calculates the quantization error of the error-containing input image signal 515, and outputs a quantization error signal 565. A diffusion/collection unit 570 performs diffusion or collection on the basis of the quantization error signal 565, and outputs an error signal 575. The diffusion/collection unit 570 is connected to an error buffer 580 which is a buffer memory for compensating for the gap between the processing speed of the CPU and that of the printer or the like, and temporarily stores a quantization error.

In general, the threshold generated by the threshold generation unit 520 is a constant, which is binarized by the quantizer 530 while performing error diffusion for the input image signal 500. To the contrary, the embodiment uses a variable to correct a texture or dot formation delay.

As shown in FIG. 4, the control signal 505 input to the threshold generation unit 520 corresponds to control data generated when the print data control unit 440 generates, from the signal 430 representing a printing state detected by the sensor 340, a signal for controlling print data. The threshold changes in accordance with a printing state detected by the sensor 340. Data generation in error diffusion processing can be controlled to uniform the print density.

More specifically, in at least one of scan operations, the state of printing on the print medium 200 by the printer engine 180 is detected by the sensor until a scan operation immediately preceding a scan operation of interest. The threshold is changed based on the detection result, and it is controlled to newly form a dot at a position apart from a printed dot.

For example, based on the printing state of up to previous scanning that has been detected by the sensor, it is controlled to increase the threshold for executing quantization and suppress dot formation at a position where a dot has already been formed or a position where the density has increased owing to intensively formed dots. In an area where no dot has been formed or an area where the print density is low, it is controlled to decrease the threshold for executing quantization and promote dot formation.

Controlling the threshold in this fashion can improve dot dispersion between passes in multipass printing. The threshold is changed in tone reduction processing based on the error diffusion method. Thus, density nonuniformity can be reduced by controlling not the dot formation ratio but the dot formation position with respect to an image signal obtained after performing pass division on the basis of the division ratio and determining the print density of each pass.

When generating print data of the first pass, print data preceding that of the first pass does not exist, so the print data control unit 440 (see FIG. 4) is not used. No control signal is input, a threshold generated by the threshold generation unit 520 takes a fixed value (or a value changed to correct a texture or dot formation delay), and general quantization is executed.

In the first embodiment, the tone reduction unit 450 performs tone reduction processing using the error diffusion method, but can also execute tone reduction processing using a dither method. More specifically, generation of print data can be controlled by controlling the threshold of a dither matrix similarly to that described in error diffusion processing.

Figure 6A:
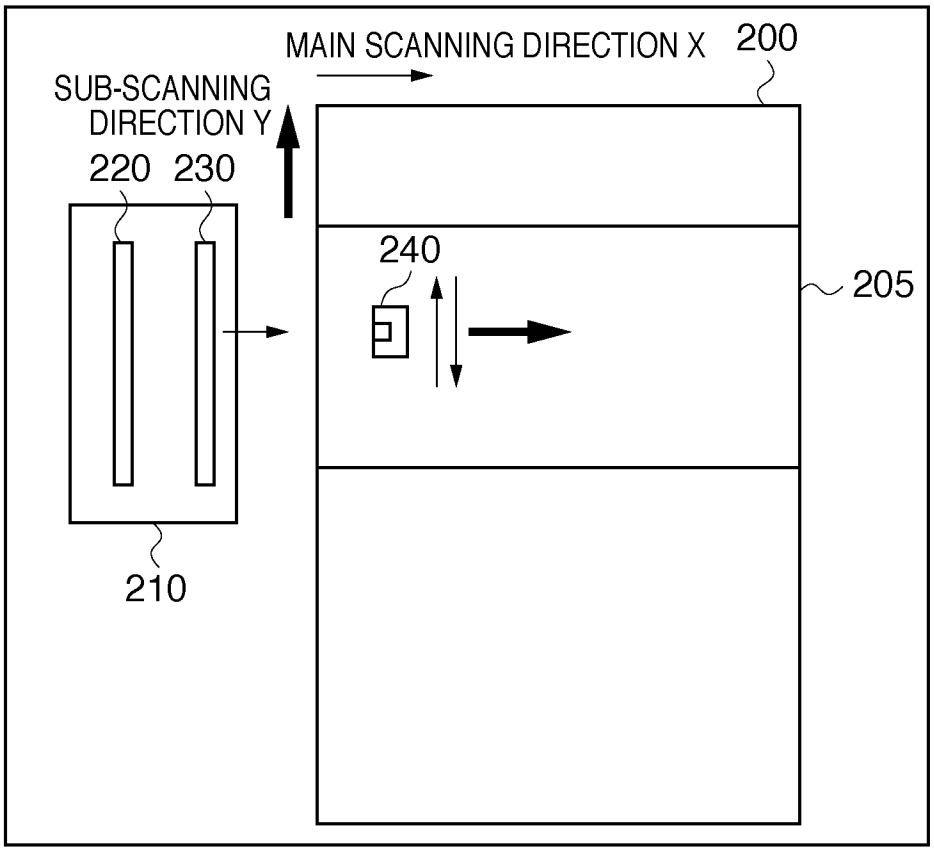
FIG. 6A is a view showing the positional relationship between the print medium 200 and the carriage 210.
Figure 6B:
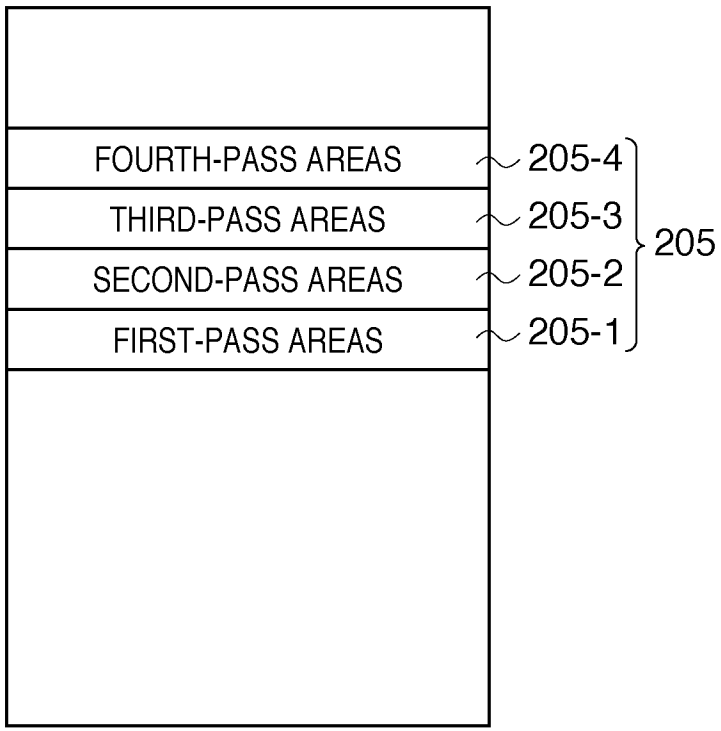
FIG. 6B is a view showing a print area 205 on the print medium 200 that is scanned by the carriage 210.

FIG. 6A is a view showing the positional relationship between the print medium 200 and the carriage 210. FIG. 6B is a view showing a print area 205 on the print medium 200 that is scanned by the carriage 210.

The carriage 210 supports the inkjet head 220 and sensor 230, and can scan both right and left. The sensor 230 is arranged downstream of the inkjet head 220 in the main scanning direction X. A diffusion matrix 240 is used for a pixel of interest for which print data is generated, and also used to perform error diffusion.

In the print area 205, an image is formed by scanning the carriage 210 and discharging ink from the inkjet head 220. A first-pass area 205-1 is printed by the inkjet head 220 by scanning the carriage 210 in the first pass. A second-pass area 205-2 is printed by the inkjet head 220 by scanning the carriage 210 in the second pass. A third-pass area 205-3 is printed by the inkjet head 220 by scanning the carriage 210 in the third pass. A fourth-pass area 205-4 is printed by the inkjet head 220 by scanning the carriage 210 in the fourth pass.

As shown in FIG. 6A, the carriage 210 scans the print medium 200 in the main scanning direction X. At the same time, the sensor 230 detects the state of printing by up to scanning immediately preceding scanning of interest. In scanning of interest, ink is discharged from the inkjet head 220 onto the print medium 200.

The sensor 230 is a line sensor whose width is equal to that of the inkjet head 220 in the sub-scanning direction Y or a width excluding a nozzle area for printing in the first pass. The sensor 230 arranged at a position preceding the inkjet head 220 in the main scanning direction X of the carriage 210 detects, in the main scanning direction X of the carriage 210, the state of printing on the print medium 200 by previous scanning.

The printing state detected by the sensor 230 is read out in the line direction because the sensor 230 is a line sensor. A detection signal is read out from the sensor 230 in a direction (longitudinal direction in FIG. 6A) perpendicular to the currently scanned print area 205. In synchronism with this processing, an input image to be printed that is temporarily stored in the RAM 120 (see FIG. 1) of the printer 10 is read out in the direction (longitudinal direction in FIG. 6A) perpendicular to the currently scanned print area 205.

Print data is generated from the input image signal to be printed that has been read out from the RAM 120 while the diffusion matrix 240, and the pixel of interest for which print data is to be generated shift in the longitudinal direction under control corresponding to the printing state detected by the sensor 230. The memory stores the generated print data.

The memory capacity is limited by the distance between the sensor 230 and the inkjet head 220. For example, when the sensor 230 is arranged adjacent to the inkjet head 220, the memory capacity becomes small. The location where the sensor 230 can be arranged is limited by the structures of the sensor 230, inkjet head 220, and carriage 210. The capacity of the print data memory depends on this positional relationship.

Print data is generated in the direction perpendicular to the currently scanned print area 205. Thus, print data is generated while vertically scanning the scanned print area 205 from the first-pass area 205-1 to the fourth-pass area 205-4 in current scanning. The multipliers 420-1 to 420-4, tone reduction units 450-1 to 450-4, and print image storages 460-1 to 460-4 (see FIG. 4) need not be provided independently for the respective colors. It suffices to provide only one multiplier 420, tone reduction unit 450, and print image storage 460 for all the colors. This arrangement can continuously generate print data.

FIGS. 16A to 16D are views showing the positions of dots formed in the respective passes. When density nonuniformity appears in multipass printing, the sensor detects the printing state of up to previous scanning, and dot formation control is executed based on the detection result.

Figure 16A:
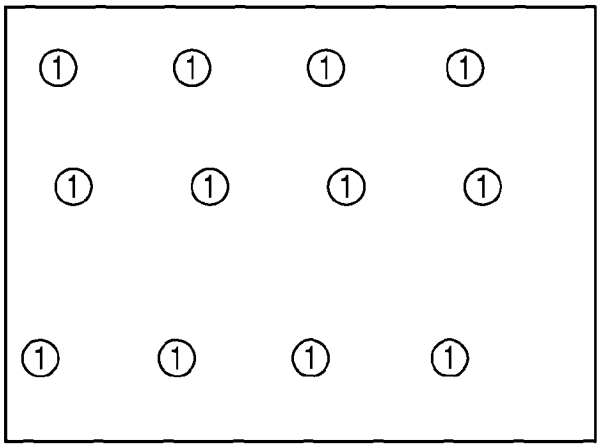
FIGS. 16A to 16D are views showing the positions of dots formed in respective passes in the first embodiment.
Figure 16B:
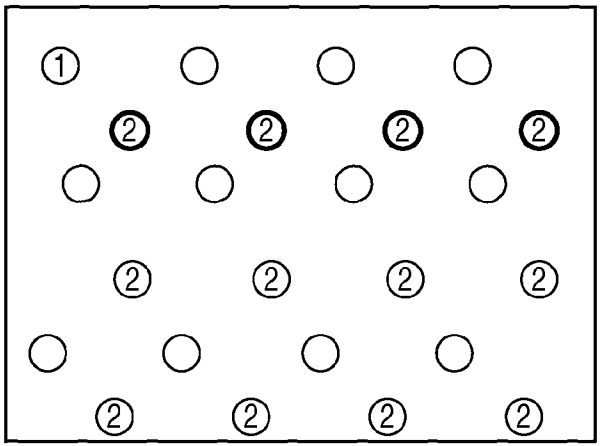

As shown in FIG. 16A, printing in the first pass is executed. Then, the print medium is conveyed, and printing in the second pass is executed as shown in FIG. 16B. When printing in the second pass, the sensor detects the printing state of the first pass. The printing state means, for example, variations in the discharge direction of the inkjet head when printing in the first pass or variations in conveyance amount upon conveying a print medium after the end of printing in the first pass.

Generation of print data corresponding to the next print processing is controlled in accordance with the detection result of the sensor. For example, a state in which the print medium conveyance amount at the end of printing in the first pass is larger than a reference value, as shown in FIG. 16B, can be detected. A state in which the nozzle discharge direction for the third line (a center line among three horizontal lines shown in FIG. 16A) printed in the first pass deviates upward can also be detected. Data to be printed in the second pass is generated based on the detected printing state of the first pass.

As for print dots (represented by "2" in ○) in the second pass, print data is generated by correcting the formation positions (e.g., nozzle discharge direction) of print dots (represented by "2" in ○) from those of print dots formed by a conventional method, as shown in FIG. 16B. Then, printing in the second pass is executed as shown in FIG. 16B.

Figure 16C:
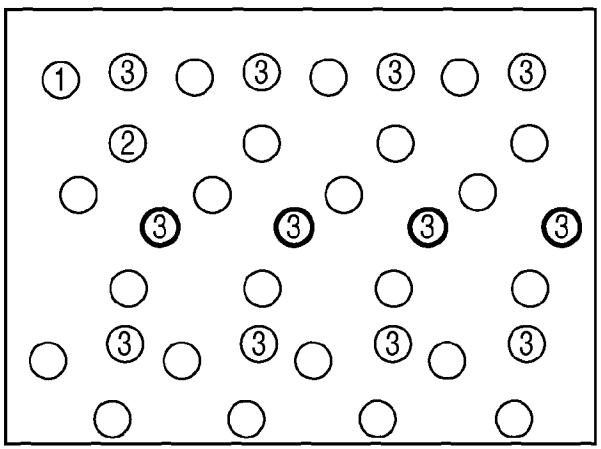

After the end of printing in the second pass, the print medium is conveyed. The sensor detects the state of printing in the first and second passes. Based on the detection result, print data of the third pass is generated. The print data is generated by correcting the formation positions (e.g., nozzle discharge direction) of print dots (represented by "3" in ○) from those of print dots formed by a conventional method. Then, printing in the third pass is executed as shown in FIG. 16C.

Figure 16D:
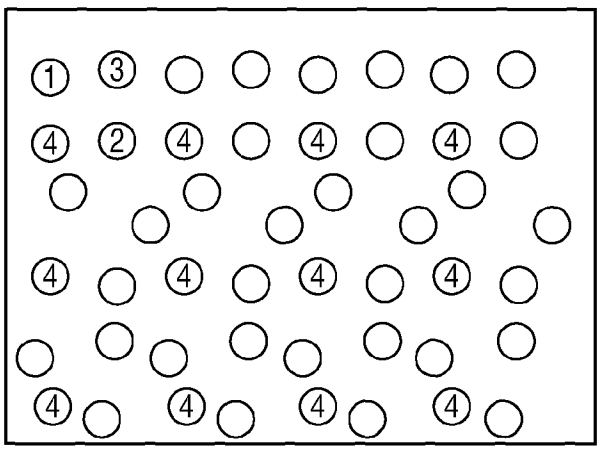

Similarly, after the end of printing in the third pass, the print medium is conveyed. The sensor detects the state of printing in the first to third passes. Based on the detection result, print data of the fourth pass is generated. Printing in the fourth pass is performed based on the generated print data of the fourth pass, as shown in FIG. 16D, thereby forming an image on the print medium. It can be confirmed that density nonuniformity is apparently reduced in FIG. 16D, compared to an image shown in FIG. 15 obtained when no control is executed.

Accordingly, the print dot formation position of each print-scan operation can be corrected by detecting the printing state of previous scanning by the sensor and generating print data on the basis of the detection result. Even if the characteristics of the inkjet head, the print medium conveyance amount, or the like varies in multipass printing, dots can be uniformly dispersed between passes, reducing density nonuniformity.

First Modification to First Embodiment

Figure 7:
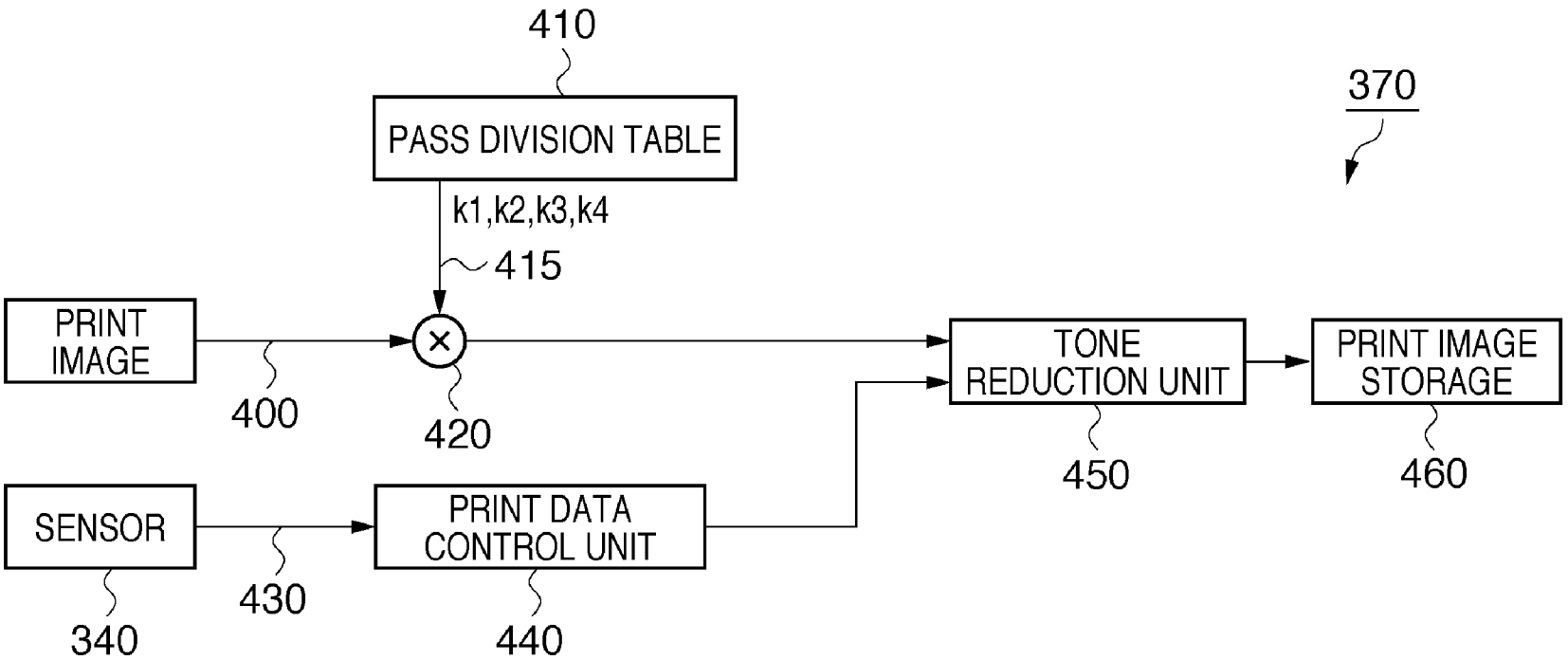
FIG. 7 is a block diagram showing the functional arrangement of the print data generation unit 370 according to the first modification to the first embodiment.

FIG. 7 is a block diagram showing the functional arrangement of the print data generation unit 370 according to the first modification to the first embodiment.

The multiplier 420 divides the print image signal 400 into the densities of the respective passes on the basis of an input from the pass division table 410. Based on the signal 430 detected by the sensor 340, the print data control unit 440 controls print data of the print image of each pass having undergone density division by the multiplier 420. Under the control of the print data control unit 440, the tone reduction unit 450 reduces the tone of the print data having undergone pass division by the multiplier 420. The print image storage 460 stores the print data of each pass having undergone tone reduction by the tone reduction unit 450.

In accordance with the print image signal 400 which has been converted into a C, M, or Y signal, and the signal 430 which has been detected by the sensor 340 and converted into a C, M, or Y signal, the carriage 210 is controlled to scan the print area 205 in the longitudinal direction, as shown in FIGS. 6A and 6B. The division ratios k1, k2, k3, and k4 of the respective passes corresponding to the print area 205 are read out from the pass division table 410. The multiplier 420 multiplies the print image signal 400 by the print densities of the respective passes corresponding to the print area 205. The print data control unit 440 performs density level correction, control data generation, and the like on the basis of the signal 430 output from the sensor 340. Based on this result, the tone reduction unit 450 generates print data corresponding to each pass. The generated print data is temporarily stored in the print image storage 460, and printed on a print medium by the print control unit 380 (see FIG. 3), forming an image. At this time, neither printing has been done in previous passes in the first-pass area 205-1 (see FIG. 6B) formed on the print medium, nor a signal from the sensor 340 exists. For this reason, an input print density is directly reduced without being controlled by the tone reduction unit 450.

Second Modification to First Embodiment

The first embodiment adopts an RGB saturated color filter as the sensor 340. Instead, a CMY complementary color filter can also be used like the second modification.

Figure 8:
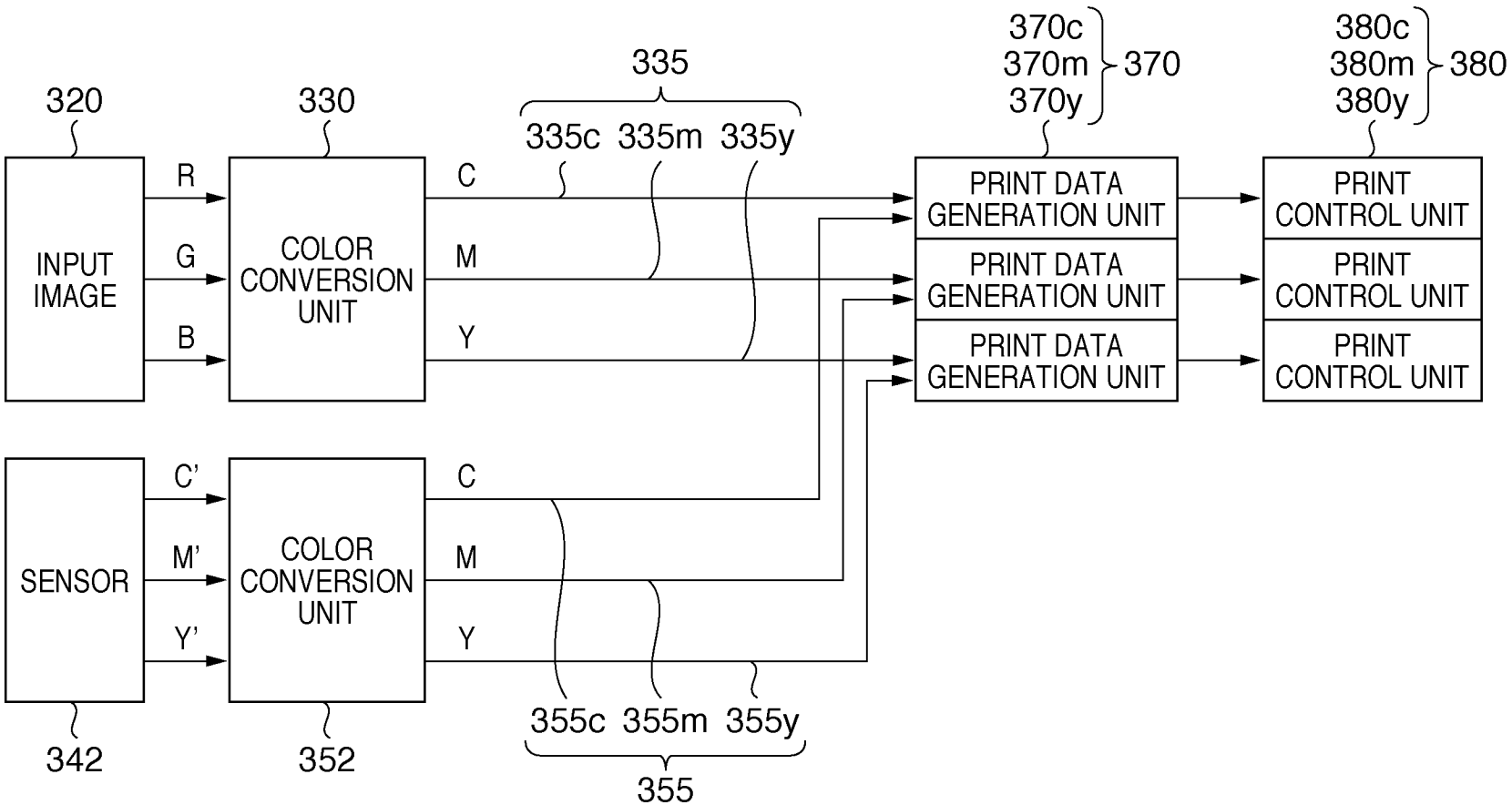
FIG. 8 is a block diagram showing the functional arrangement of an image forming apparatus according to the second modification to the first embodiment.

FIG. 8 is a block diagram showing the functional arrangement of an image forming apparatus according to the second modification to the first embodiment. FIG. 14 is a view showing the positions of dots formed in the respective passes in the second modification to the first embodiment. In FIG. 14, ○ represent dots formed on a print medium, and numerals "1", "2", "3", and "4" in ○ represent the numbers of scan operations which formed dots.

In this case, a printing state detected by a sensor 342 is input to a color conversion unit 352 not as R, G, and B signals as shown in FIG. 3, but as C, M, and Y signals representing signals C', M', and Y', as shown in FIG. 8. The color conversion unit 352 converts the signals C', M', and Y' input from the sensor 342 into signals C, M, and Y representing the ink colors. Even when a CMY complementary color filter is used as the sensor 342, the same effects as those by the RGB saturated color filter can be obtained.

Second Embodiment

In the first embodiment, the dot position is controlled based on a printing state detected by the sensor. In the second embodiment, unlike the first embodiment, the print density is corrected based on a printing state detected by the sensor. These embodiments may also be practiced singly or in combination with each other. The same reference numerals as those in the first embodiment denote the same parts, and a description thereof will not be repeated.

As shown in FIG. 3, a color conversion unit 330 converts an input image 320 to be printed into C, M, and Y signals for printing by a printer 10 (see FIG. 1). The C, M, and Y signals are input to a print data generation unit 370 for the respective colors. Similarly, signals detected by a sensor 340 for detecting a printing state are converted by a color conversion unit 350 into C, M, and Y signals. The C, M, and Y signals are input to the print data generation unit 370 for the respective colors.

The print data generation unit 370 corrects the print density ratio of each print-scan operation for each nozzle on the basis of a printing state detected by the sensor 340. More specifically, the print data generation unit 370 corrects the density level of the input image 320 on the basis of the C, M, and Y signals converted by the color conversion unit 350 from a signal detected by the sensor 340.

Figure 9:
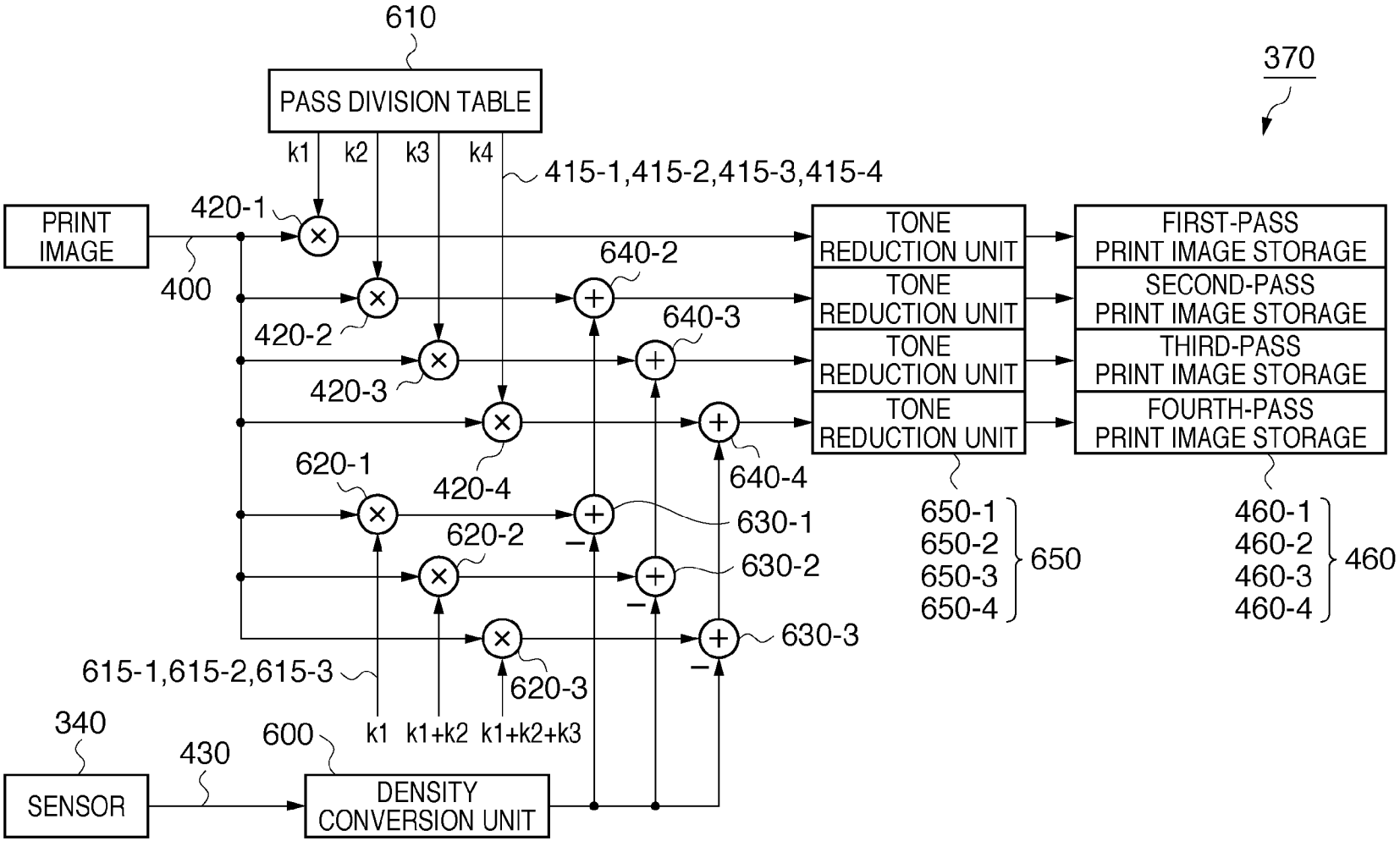
FIG. 9 is a block diagram showing the functional arrangement of a print data generation unit 370 according to the second embodiment.

FIG. 9 is a block diagram showing the functional arrangement of the print data generation unit 370 according to the second embodiment. FIG. 9 exemplifies the functional arrangement of one of a cyan print data generation unit 370*c*, magenta print data generation unit 370*m*, and yellow print data generation unit 370*y* in the print data generation unit 370 shown in FIG. 3.

A density conversion unit 600 performs print density conversion on the basis of a signal 430 detected by the sensor 340.

A pass division table 610 stores division ratios k1, k2, k3, and k4 for multipass division. A multiplier 620-1 multiplies the print image signal 400 by a division ratio k1 615-1 of the first pass. A multiplier 620-2 multiplies the print image signal 400 by a sum k1+k2 615-2 of the print division ratios of the first and second passes. A multiplier 620-3 multiplies the print image signal 400 by a sum k1+k2+k3 615-3 of the print division ratios of the first to third passes.

An adder 630-1 calculates the difference between a print density detected by the sensor 340, and the print density of the first pass that has been calculated by the multiplier 620-1. An adder 630-2 calculates the difference between the print density detected by the sensor 340, and the total print density of the first and second passes that has been calculated by the multiplier 620-2. An adder 630-3 calculates the difference between the print density detected by the sensor 340, and the total print density of the first to third passes that has been calculated by the multiplier 620-3.

An adder 640-2 adds, to the print density of the second pass, the difference (output result of the adder 630-1) between the print density of the first pass and the print density detected by the sensor 340. An adder 640-3 adds, to the print density of the third pass, the difference (output result of the adder 630-2) between the total print density of the first and second passes and the print density detected by the sensor 340. An adder 640-4 adds, to the print density of the fourth pass, the difference (output result of the adder 630-3) between the total print density of the first to third passes and the print density detected by the sensor 340.

A tone reduction unit 650-1 generates print data of the first pass on the basis of an output from a multiplier 420-1 which has calculated the print density of the first pass. A tone reduction unit 650-2 generates print data of the second pass on the basis of an output from the adder 640-2 which has calculated the print density of the second pass. A tone reduction unit 650-3 generates print data of the third pass on the basis of an output from the adder 640-3 which has calculated the print density of the third pass. A tone reduction unit 650-4 generates print data of the fourth pass on the basis of an output from the adder 640-4 which has calculated the print density of the fourth pass.

In the second embodiment, a cumulative density obtained by calculating the division ratio of each pass by the multiplier 420 for the print image signal 400 will be referred to as the target output density of each pass. The "print density" means not the density of actual printing on a print medium but a value used to perform processing.

Print image signals converted into the respective ink colors are input to multipliers 420-1, 420-2, 420-3, and 420-4 for calculating the print densities of the respective passes. The multipliers 420-1, 420-2, 420-3, and 420-4 calculate the target output densities of the respective passes by multiplying the print image signals by the division ratios k1, k2, k3, and k4 read out from the pass division table 610.

Similar to the first embodiment, when generating print data of the first pass, the multiplier 420-1 calculates the print density of the first pass, the tone reduction unit 650-1 generates print data, and a first-pass print image storage 460-1 stores the generated print data.

When generating print data of the second and subsequent passes, the multipliers 420-2 to 420-4 calculate the print densities of the respective passes. At the same time, the multipliers 620-1 to 620-3 calculate the target output densities of previous scan operations.

When printing in the second pass, the multiplier 620-1 calculates the target output density of the first pass by multiplying the print image signal 400 by the division ratio k1 of the first pass. A signal representing a printing state detected by the sensor 340 is color-converted into a C, M, or Y signal. The density conversion unit 600 converts the C, M, or Y signal into a detected density. To calculate a difference from the calculated target output density, the detected density of the first pass is input to the adder (subtracter) 630-1 together with an output from the multiplier 620-1. The adder 640-2 adds the print density of the second pass, and the difference between the target output density and detected density of the first pass which has been calculated by the adder 630-1. The tone reduction unit 650-2 generates print data on the basis of the print density of the second pass that has been corrected by the difference between the target output density and detected print density of the first pass. A second-pass print image storage 460-2 stores the generated print data of the second pass as a print image of the second pass.

Similarly, when printing in the third pass, the multiplier 420-3 calculates the print density of the third pass. At the same time, the multiplier 620-2 multiplies the print image signal 400 by the sum k1+k2 of the division ratios of the first and second passes, calculating the total target output density of the first and second passes in which printing has already been executed. The density conversion unit 600 converts a detected density after printing in the second pass on the basis of a printing state detected by the sensor 340. The adder 630-2 calculates the difference between the density detected by the sensor 340, and the target output density after printing in the second pass that has been calculated by the multiplier 620-2. The adder 640-3 adds the difference to the print density of the third pass. The tone reduction unit 650-3 generates print data on the basis of the print density of the third pass that has been corrected by the difference between the target output density after printing in the second pass and the detected print density. A third-pass print image storage 460-3 stores the generated print data of the third pass as a print image of the third pass.

Also when printing in the fourth pass, the multiplier 420-4 calculates the print density of the fourth pass. At the same time, the multiplier 620-3 multiplies the print image signal 400 by the sum of the division ratios of the first to third passes, calculating the total target output density of the first to third passes in which printing has already been executed. The density conversion unit 600 converts a detected density after printing in the third pass on the basis of a printing state detected by the sensor 340. The adder 630-3 calculates the difference between the density detected by the sensor 340, and the target output density after printing in the third pass that has been calculated by the multiplier 620-3. The adder 640-4 adds the difference to the print density of the fourth pass. The tone reduction unit 650-4 generates print data on the basis of the print density of the fourth pass that has been corrected by the difference between the target output density after printing in the third pass and the detected print density. A fourth-pass print image storage 460-4 stores the generated print data of the fourth pass as a print image of the fourth pass.

The print data generation unit 370 functions as a cumulative density calculation unit which calculates a cumulative density to print on a print medium in up to a print-scan operation immediately preceding a print-scan operation of interest in at least one of print-scan operations. The print data generation unit 370 also functions as a difference calculation unit which calculates the difference between the cumulative density calculated by the cumulative density calculation unit and a density detected by the sensor. The print data generation unit 370 corrects print data of print-scan operations subsequent to a print-scan operation of interest so as to eliminate the difference calculated by the difference calculation unit.

A print control unit 380 (see FIG. 3) forms an image on a print medium by driving an inkjet head on the basis of print data stored in the print image storage 460-1, 460-2, 460-3, or 460-4 (to be also referred to as a print image storage 460 hereinafter).

In the second embodiment, the image forming apparatus has the same arrangement as that in the first embodiment (see FIG. 3). FIG. 9 shows processing after color separation into C, M, and Y signals corresponding to the ink colors. The sensor 340 detects a printing state. The print density of a print result by previous scanning is detected, and the difference (i.e., density error) between the detected print density and a target output density at which printing should be originally done is calculated. Print data is so generated as to correct the print density by the density error in printing of the next scanning. Thus, signals detected by the sensor may also be converted not into C, M, and Y ink colors but into a CMY system ideal for image formation. In this case, a density error with respect to the ideal CMY color space is calculated to correct print data. Even when a calculated color and the color of an image formed on a print medium differs from each other owing to a combination of ink and the print medium, the color can be corrected.

First Modification to Second Embodiment

Figure 10:
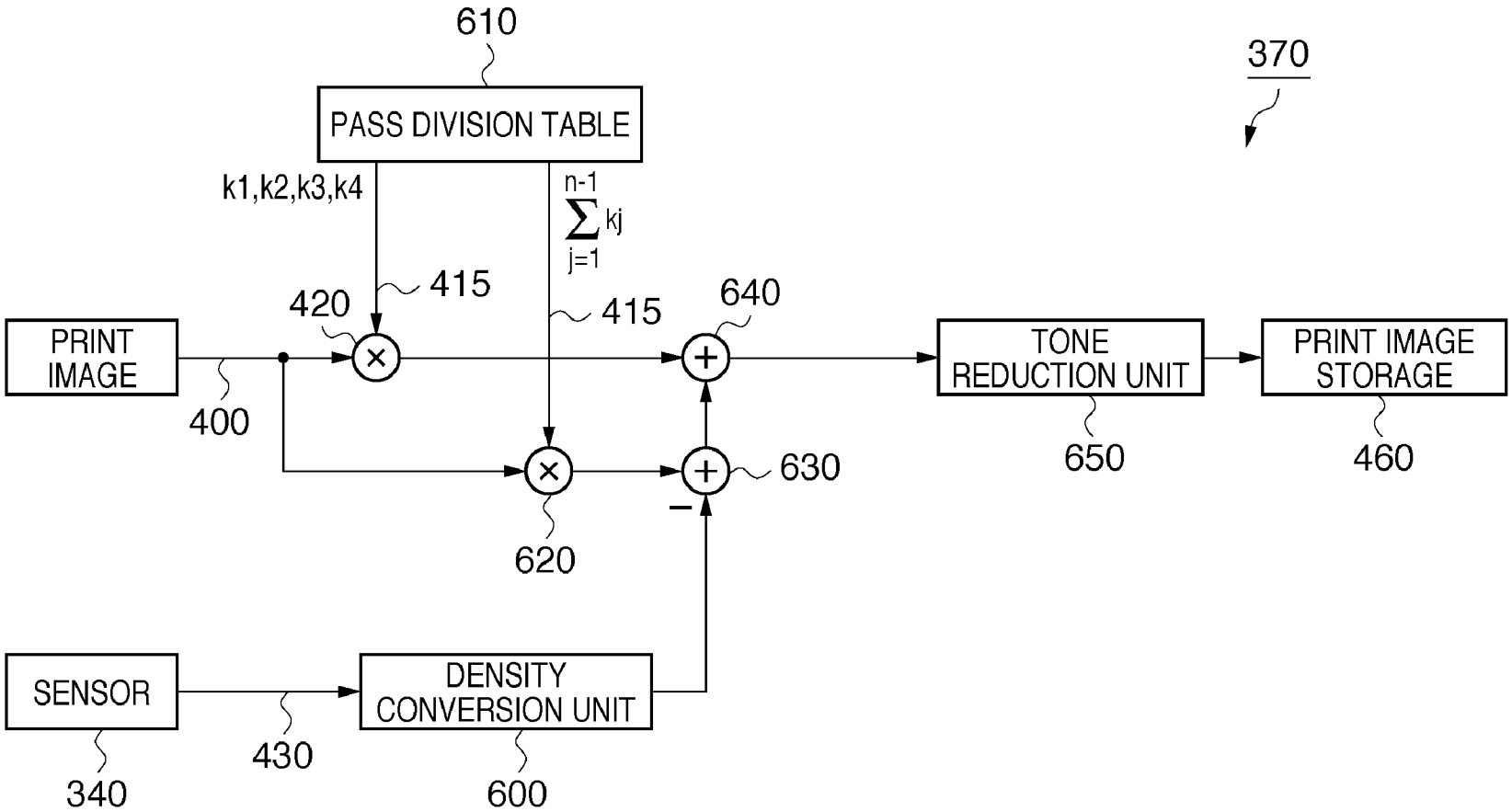
FIG. 10 is a block diagram showing the functional arrangement of the print data generation unit 370 according to the first modification to the second embodiment.

FIG. 10 is a block diagram showing the functional arrangement of the print data generation unit 370 according to the first modification to the second embodiment.

A multiplier 420 divides the print image signal 400 into the densities of the respective passes on the basis of an input from the pass division table 610. A multiplier 620 calculates a target output density by multiplying the print image signal 400 by a cumulative value. An adder 630 calculates the difference between the target output density calculated by the multiplier 620 and a density which has been detected by the sensor 340 and converted by the density conversion unit 600. An adder 640 adds the difference calculated by the adder 630 to the print density of each pass. A tone reduction unit 650 generates print data by reducing the tone of the print image of each pass to which the adder 640 has added the difference. The print image storage 460 stores the print data of each pass having undergone tone reduction by the tone reduction unit 650.

In accordance with the print image signal 400 which has been converted into a C, M, or Y signal, and the signal 430 which has been detected by the sensor 340 and converted into a C, M, or Y signal, a carriage 210 is controlled to scan the print area 205 in the longitudinal direction, as shown in FIGS. 6A and 6B. The division ratios k1, k2, k3, and k4 of the respective passes corresponding to the print area 205 (see FIG. 6B) are read out from the pass division table 610. The multiplier 420 multiplies the print image signal 400 by print densities corresponding to the print area 205. In the second and subsequent passes, when scanning of interest corresponds to the nth pass, the sum of the division ratios of passes up to the (n-1)th pass immediately preceding the nth pass is output in accordance with the pass division table 610:

$$\sum_{j=1}^{n-1} kj \ (0 \text{ for } n = 1) \tag{1}$$

Then, the multiplier 620 calculates a target output density.

In this manner, the total target output density of passes up to the (n−1)th pass is calculated when printing in the nth pass.

The density conversion unit 600 converts the signal 430 detected by the sensor 340 into a detected density. The adder 630 calculates the difference between the target output density and the detected density. The adder 640 adds the calculated difference to the print density of each pass. The tone reduction unit 650 generates print data corresponding to each pass. The print image storage 460 temporarily stores the generated print data. The print control unit prints the print data on a print medium, forming an image.

As described above, according to the second embodiment, the difference between the target output density of previous scanning and a density detected by the sensor 340 is added for the next printing in the second and subsequent passes in multipass printing. As a result, density nonuniformity can be more reliably reduced. When a density error is generated owing to variations in inkjet head characteristics, print medium conveyance amount, and the like, the sensor 340 detects the print density of previous scanning in scanning of interest in the second and subsequent passes. The difference (i.e., a generated density error) between the detected density and a target output density for printing is calculated. Print data of the pass of interest is corrected to eliminate the calculated difference, thereby more reliably reducing density nonuniformity.

Third Embodiment

Figure 11:
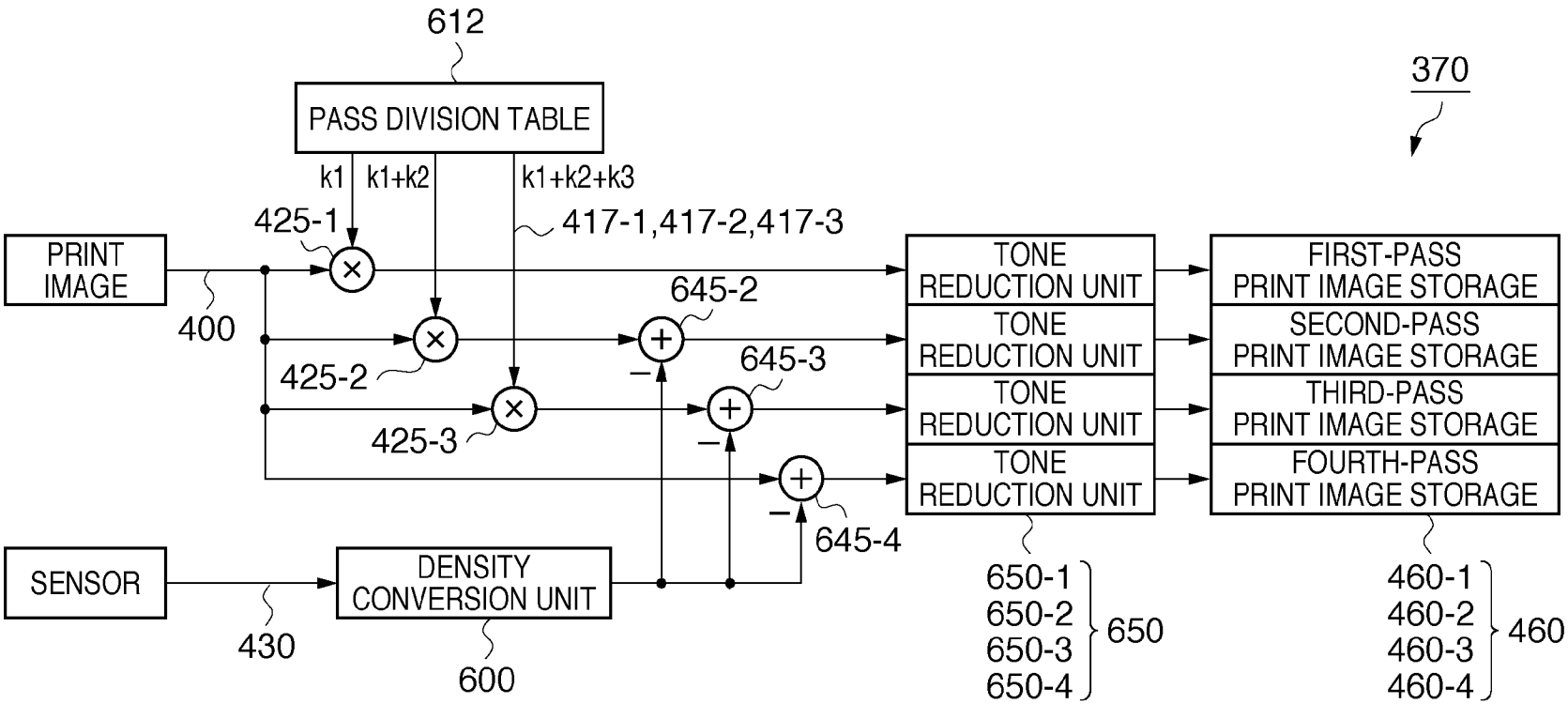
FIG. 11 is a block diagram showing the functional arrangement of a print data generation unit 370 according to the third embodiment.

FIG. 11 is a block diagram showing the functional arrangement of a print data generation unit 370 according to the third embodiment. In the first embodiment (see FIG. 3), the color conversion unit 330 converts the input image 320 to be printed into C, M, and Y signals for printing by an inkjet printer. The color conversion unit 350 also converts a signal detected by the sensor 340 into C, M, and Y signals. The C, M, and Y signals are input to the print data generation units for the respective colors. The print data generation units perform density level correction and the like by using the C, M, and Y signals converted by the color conversion unit 350 from a signal detected by the sensor 340. The input image signal 320 and the signal detected by the sensor 340 each are converted by the color conversion units 330 and 350 into C, M, and Y signals, which are input to the print data generation units 370. The same reference numerals as those in the second embodiment denote the same parts, and a description thereof will not be repeated. The third embodiment will mainly explain a difference from the arrangement of the print data generation unit 370 shown in FIG. 9 in the second embodiment.

A pass division table 612 stores the cumulative densities (target output densities) of up to respective scan operations in multipass division. A multiplier 425-1 multiplies a print image signal 400 by a division ratio k1 417-1 of the first pass. A multiplier 425-2 multiplies the print image signal 400 by a sum k1+k2 417-2 of the division ratios of the first and second passes, calculating the cumulative density of up to the second pass. A multiplier 425-3 multiplies the print image signal 400 by a sum k1+k2+k3 417-3 of the print division ratios of the first to third passes, calculating the cumulative density of up to the third pass.

An adder 645-2 calculates the print density of the second pass by calculating the difference between a print density in the first pass that has been detected by the sensor, and a cumulative density (target output density after printing in the second pass) which has been calculated by a multiplier 425-2 and at which printing should be done in up to the second pass. An adder 645-3 calculates the print density of the third pass by calculating the difference between a print density upon printing in the first and second passes that has been detected by the sensor, and a cumulative density (target output density after printing in the third pass) which has been calculated by a multiplier 425-3 and at which printing should be done in up to the third pass. An adder 645-4 calculates the print density of the fourth pass by calculating the difference between and a print density upon printing in up to the third pass that has been detected by the sensor, and a cumulative density (target output density of the final pass) at which printing should be done in up to the final pass.

A tone reduction unit 650-1 generates print data of the first pass from an output from a multiplier 420-1 which has calculated the print density of the first pass. A tone reduction unit 650-2 generates print data of the second pass from an output from an adder 640-2 which has calculated the print density of the second pass. A tone reduction unit 650-3 generates print data of the third pass from an output from an adder 640-3 which has calculated the print density of the third pass. A tone reduction unit 650-4 generates print data of the fourth pass from an output from an adder 640-4 which has calculated the print density of the fourth pass.

Similar to the first and second embodiments, the functional arrangement of one of a cyan print data generation unit 370*c*, magenta print data generation unit 370*m*, and yellow print data generation unit 370*y* in a print data generation unit 370 shown in FIG. 3 will be exemplified. The third embodiment calculates the differences between cumulative target output densities for printing by the print pass (nth pass) and passes up to a preceding pass ((n−1)th pass), and densities detected by the sensor upon printing by up to previous scanning. Then, printing is executed at the difference densities.

Print image signals converted into the respective ink colors are input to the multipliers 425-1, 425-2, and 425-3 for calculating the cumulative print densities of the respective passes. The multipliers 425-1, 425-2, and 425-3 multiply the print image signals by coefficients (k1, k1+k2, and k1+k2+k3) read out from the pass division table 612, determining the cumulative print densities of the respective passes.

Similar to FIG. 4, when generating print data of the first pass, the multiplier 425-1 calculates the print density of the first pass, the tone reduction unit 650-1 generates print data, and a first-pass print image storage 460-1 stores the generated print data.

When generating print data of the second pass, the multiplier 425-2 calculates the cumulative print density (sum of the print densities of the first and second passes) of up to the second pass. A detection signal representing a printing state detected by the sensor is color-converted into a C, M, or Y signal. The density conversion unit 600 converts the C, M, or Y signal into a detected density. The first-pass density detected by the sensor is input to the adder (subtracter) 645-2 in order to calculate the print densities of the first and second passes by comparing the detected first-pass density with the cumulative target output density of the second pass. The adder 645-2 calculates the print density of the second pass by calculating the difference between the cumulative target output density of the first and second passes and a print density obtained by detecting a printing state by the sensor after printing in the first pass. The tone reduction unit 650-2 generates print data on the basis of the calculated print density of the second pass. A second-pass print image storage 460-2 stores the generated print data of the second pass as a print image of the second pass.

When generating print data of the third pass, the multiplier 425-3 calculates the cumulative print density of the first to third passes. The density conversion unit 600 converts a printing state detected by the sensor into a detected density after printing in the second pass. The detected density, which is the state of printing in the first and second passes detected by the sensor, is input to the adder (subtracter) 645-3 in order to calculate the print density of the third pass by comparing the detected density with the cumulative target output density of the first to third passes. The adder 645-3 calculates the print density of the third pass by calculating the difference between the cumulative target output density of the first to third passes and a print density obtained by detecting a printing state by the sensor after printing in the second pass. The tone reduction unit 650-3 generates print data on the basis of the calculated print density of the third pass. A third-pass print image storage 460-3 stores the generated print data of the third pass as a print image of the third pass.

When generating print data of the fourth pass, a multiplier 425 for calculating the cumulative print density of previous passes is not necessary because the fourth pass is a final pass and the cumulative print density of the first to fourth passes is the density of an input print image itself. The sensor detects the printing state of the first to third passes with respect to the target output density of the fourth pass. The detected print density is input to the adder (subtracter) 645-4 in order to calculate the print density of the fourth pass by comparing the detected print density with the print image. The adder 645-4 calculates the print density of the fourth pass by calculating the difference between the cumulative target output density (density of the print image) of the first to fourth passes and a print density obtained by detecting a printing state by the sensor after printing in the third pass. The tone reduction unit 650-4 generates print data on the basis of the calculated print density of the fourth pass. A fourth-pass print image storage 460-4 stores the generated print data of the fourth pass as a print image of the fourth pass.

First Modification to Third Embodiment

Figure 12:
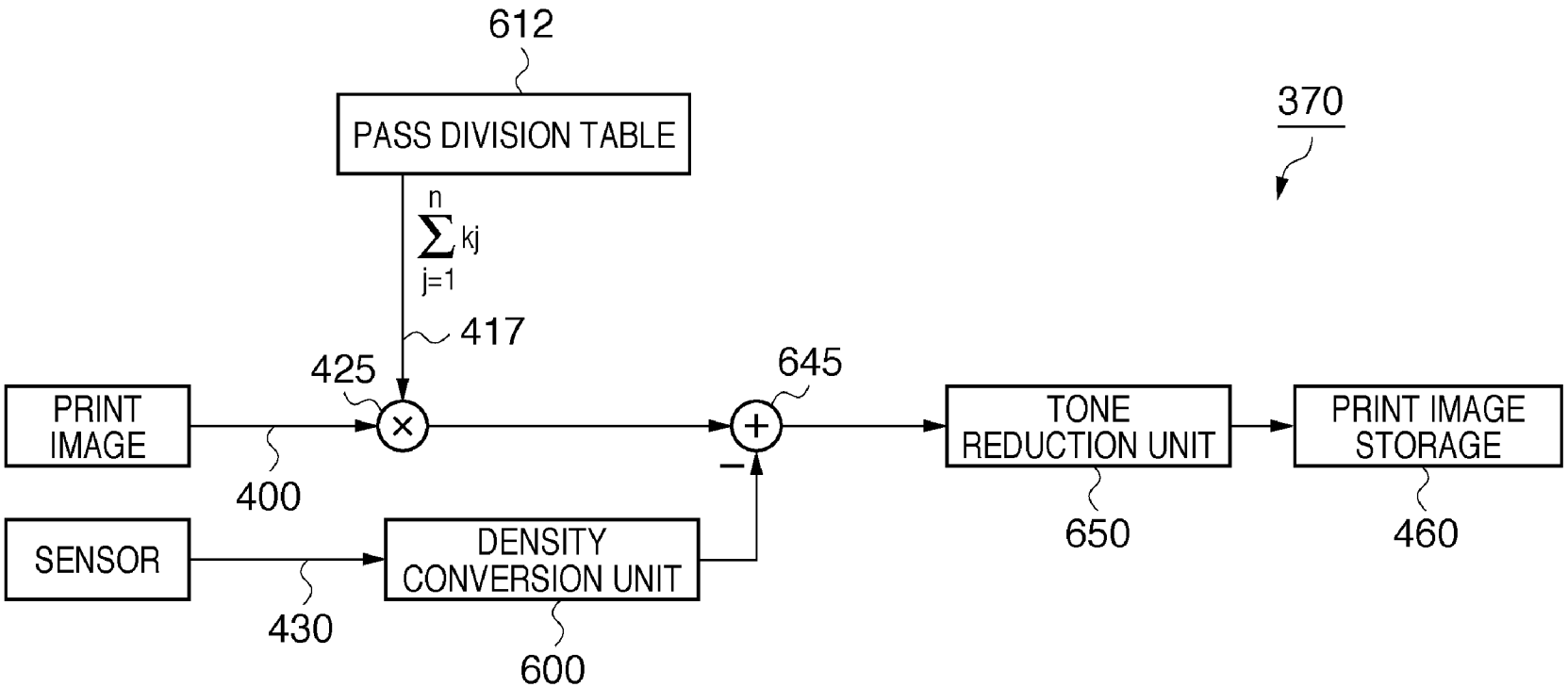
FIG. 12 is a block diagram showing the functional arrangement of the print data generation unit 370 according to the first modification to the third embodiment.

FIG. 12 is a block diagram showing the functional arrangement of the print data generation unit 370 according to the first modification to the third embodiment.

A multiplier 425 calculates the target output density of the current scanning by multiplying the print image signal 400 by the sum (target output density) of the division ratio of up to the current scanning. An adder 645 calculates the difference between the target output density calculated by the multiplier 425 and a density detected by the sensor. A tone reduction unit 650 generates print data on the basis of the print image of each pass. A print image storage 460 stores the print data of each pass having undergone tone reduction by the tone reduction unit 650.

As shown in FIGS. 6A and 6B, the print area 205 is scanned in the longitudinal direction in accordance with the print image signal 400 which has been converted into a C, M, or Y signal, and the signal 430 which has been detected by the sensor, read out, and converted into a C, M, or Y signal. The sums (target output densities) k1, k1+k2, and k1+k2+k3 of the cumulative division ratios of the division ratios k1, k2, k3, and k4 corresponding to the areas of the respective passes are read out from the pass division table 612 in accordance with the print image signal 400. The readout coefficient is given as the sum of the division ratios of the first to nth passes:

$$\sum_{j=1}^{n} kj \tag{2}$$

The multiplier 425 calculates a cumulative target output density corresponding to a pass area by multiplying the print image signal 400 by a division ratio read out from the pass division table 612. The density conversion unit 600 converts the signal 430 detected by the sensor into a detected density. The adder 645 calculates the difference between the target output density and a density detected upon printing by previous scanning. The calculation result is the sum of the print density of the current scanning (nth pass) and the print density error of scanning ((n−1)th pass) immediately preceding the current scanning. As a corrected print density, the tone reduction unit 650 generates print data corresponding to each pass. The print image storage 460 temporarily stores the generated print data. A print control unit 380 (see FIG. 3) prints the print data on a print medium, forming an image.

As described above, according to the third embodiment, the difference between the target output density and a print density detected in up to scanning preceding a pass of interest is calculated. The density is corrected to eliminate the difference, thereby more reliably reducing density nonuniformity. Even when a density error is generated owing to variations in inkjet head characteristics, print medium conveyance amount, and the like, density nonuniformity can be corrected. The third embodiment omits some multipliers and adders, and can more simplify the control circuit than the second embodiment.

Fourth Embodiment

In the first to third embodiments, as shown in FIG. 2A, the sensor 230 is arranged at a position preceding the inkjet head in a direction (main scanning direction X) in which the print-scan operation is performed. Generation of print data is controlled using a detection signal from the sensor 230. In the fourth embodiment, unlike the first to third embodiments, a sensor 230 is arranged at a position subsequent to the inkjet head. In the fourth embodiment, the same reference numerals as those in the first embodiment denote the same parts, and a description thereof will not be repeated.

When the sensor 230 is arranged at a position preceding the inkjet head in the main scanning direction X of the carriage, the state of printing in scanning of interest cannot be detected, but that in up to scanning immediately preceding scanning of interest can be detected. For this reason, a printing state including not only variations (e.g., variations in discharge amount or discharge direction) in inkjet head characteristics, but also variations in print medium conveyance amount can be detected.

However, it is necessary to generate print data on the basis of a printing state detected by the sensor 230, and when the inkjet head 220 reaches the position of the sensor which has detected the printing state, drive the inkjet head 220 along with scanning of the carriage in accordance with the generated print data. For this reason, unlike conventional print control using a band memory, it is necessary to generate print data while the sensor detects a printing state, and drive the inkjet head in accordance with scanning of the carriage. In the print control using a band memory, generation of all print data is completed and stored in the band memory before scanning the carriage, and the print control unit forms an image by driving the inkjet head in synchronism with scanning of the carriage and discharging ink. The direction in which print data is generated is shown in FIG. 6A, and has already been explained.

To the contrary, the fourth embodiment assumes a case wherein the sensor 230 is arranged at a position subsequent to an inkjet head 220 in the main scanning direction X, as shown in FIG. 2B.

Figure 13:
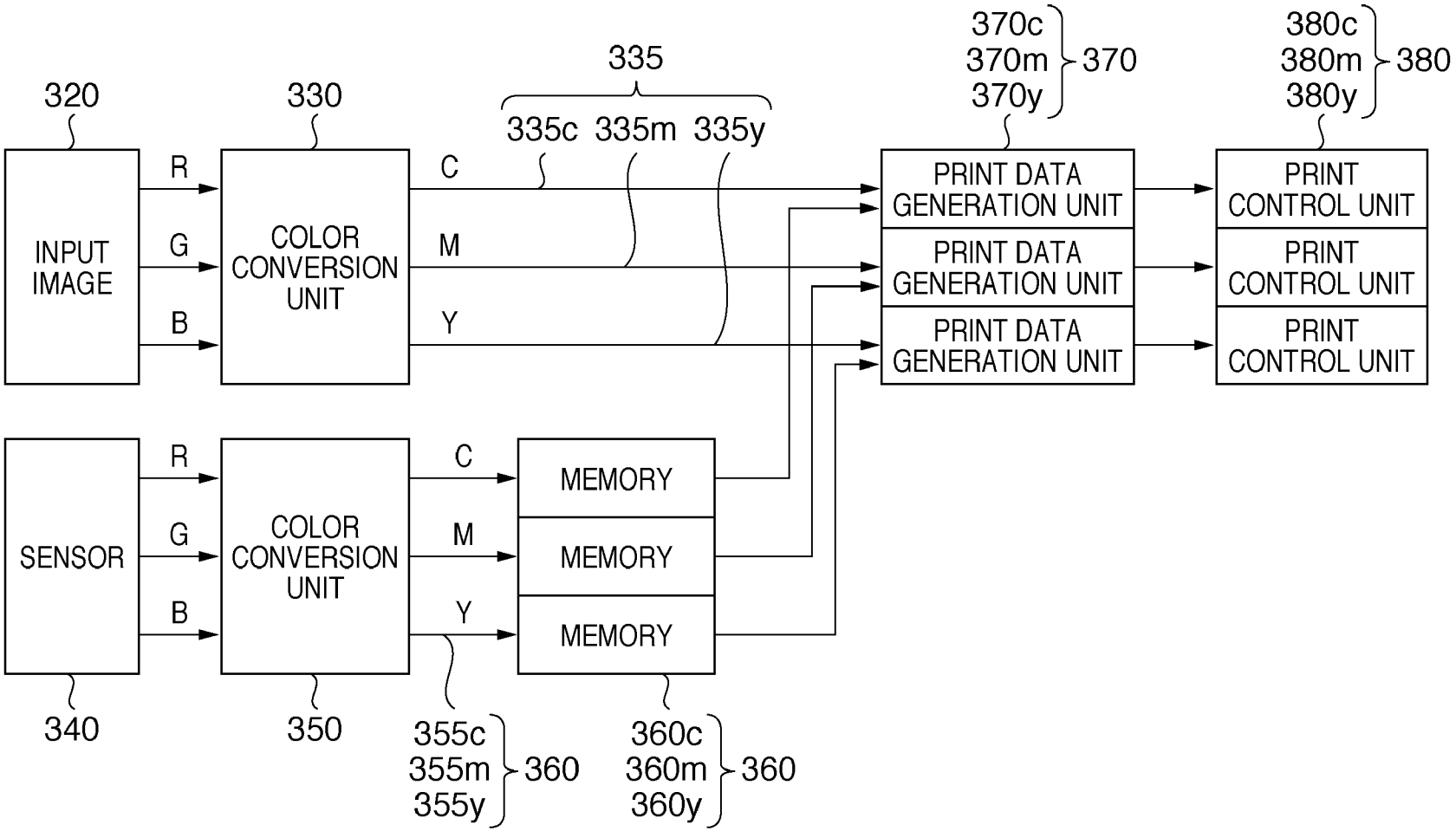
FIG. 13 is a block diagram showing the functional arrangement of an image forming apparatus according to the fourth embodiment.

FIG. 13 is a block diagram showing the functional arrangement of an image forming apparatus according to the fourth embodiment. A memory 360*c* temporarily stores a cyan signal obtained by converting a printing state detected by a sensor 340 into C, M, and Y signals corresponding to the ink colors by a color conversion unit 350. A memory 360*m* temporarily stores a magenta signal obtained by converting a printing state detected by the sensor 340 into C, M, and Y signals corresponding to the ink colors by the color conversion unit 350. A memory 360*y* temporarily stores a yellow signal obtained by converting a printing state detected by the sensor 340 into C, M, and Y signals corresponding to the ink colors by the color conversion unit 350.

In the fourth embodiment, as described above, the sensor 340 is arranged upstream of the inkjet head 220 (see FIG. 2B). Thus, immediately after printing by the inkjet head 220, the sensor 340 detects the printing state.

Detection signals representing a printing state detected by the sensor 340 are converted by a color conversion unit 350 into C, M, and Y signals 355 corresponding to the ink colors. The C, M, and Y signals 355 are stored in the cyan memory 360*c*, magenta memory 360*m*, and yellow memory 360*y* of a memory 360. The detection signals stored in the memory 360 are input to a print data generation unit 370 together with print image signals obtained by converting input image signals 320 into C, M, and Y signals 335 corresponding to the ink colors by a color conversion unit 330. Then, print data is generated.

As described above, according to the fourth embodiment, none of detection of a printing state by the sensor, generation of print data, and printing by the inkjet head need be performed in real time while scanning the carriage. Thus, these processes can be executed separately. Since no print data is generated in real time along with scanning of the carriage, no print data need be generated in the nozzle array direction of the inkjet head, unlike FIG. 6A. Print data can be generated in the main scanning direction, similar to a conventional method. Hence, hardware hardly imposes restrictions on generation of print data (e.g., the timing, and latency till access to the error memory). Similar to the conventional method, the band memory can be used to control printing in accordance with scanning of the carriage.

The present invention can, therefore, be applied to even an embodiment in which print data is generated prior to scanning of the carriage and printing is done based on the print data stored in the band memory.

Other Embodiments

The embodiments may also be applied to a system including a plurality of devices (e.g., a host computer, interface device, reader, and printer), or an apparatus (e.g., a copying machine, multi-functional peripheral, or facsimile apparatus) formed by a single device.

The present invention may also be applied by supplying a computer-readable storage medium (or recording medium) which stores the computer program codes of software for implementing the functions of the above-described embodiments to a system or apparatus. The present invention may also be applied by reading out and executing the program codes stored in the storage medium by the computer (or the CPU or MPU) of the system or apparatus. In this case, the program codes read out from the storage medium implement the functions of the above-described embodiments, and the storage medium which stores the program codes constitutes the embodiments. Also, the present invention includes a case wherein an operating system (OS) or the like running on the computer performs some or all of actual processes on the basis of the instructions of the program codes and thereby implements the functions of the above-described embodiments.

The present invention also includes a case wherein the program codes read out from the storage medium are written in the memory of a function expansion card inserted into the computer or the memory of a function expansion unit connected to the computer, and the CPU of the function expansion card or function expansion unit performs some or all of actual processes on the basis of the instructions of the program codes and thereby implements the functions of the above-described embodiments.

When the embodiments are applied to the computer-readable storage medium, the storage medium stores computer program codes corresponding to the above-described functional arrangements.

The sensor length, arrangement, pass division count, pass division ratio, and the like in the first to fourth embodiments are merely examples, and are not limited as constituent elements of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-116295, filed Apr. 25, 2008, which is hereby incorporated by reference herein in its entirety.

What is claimed is:

1. An image forming apparatus which forms a halftone image on a print medium using multipass processing of reciprocally scanning a single area on the print medium by a printhead a plurality of number of times, forming dots on the print medium in one of reciprocal scan operations, and moving the printhead to a home position in the other reciprocal scan operation, the apparatus comprising:

generator configured to generate print data of each print-scan operation;

printing unit configured to print the halftone image on the print medium on the basis of the print data generated by the generator; and detector, in at least one print-scan operation out of a plurality of print-scan operations, configured to detect a state of printing on the print medium by the printing unit in up to a print-scan operation immediately preceding a print-scan operation of interest, wherein the generator corrects the print data in synchronism with printing by the printing unit on the basis of the printing state detected by the detector.

2. The apparatus according to claim 1, wherein the detector includes a sensor which is arranged at a position preceding the printhead in a direction in which the print-scan operation is performed, and detects the printing state, and the sensor moves in synchronism with the printing unit.

3. The apparatus according to claim 1, further comprising:

cumulative density calculation unit, in at least one print-scan operation out of the plurality of print-scan operations, configured to calculate a cumulative density to print on the print medium in up to a print-scan operation immediately preceding the print-scan operation; and difference calculation unit configured to calculate a difference between the cumulative density calculated by the cumulative density calculation unit and a density detected by the detector, wherein the generator corrects the print data of the print-scan operation of interest and the print data of a print-scan operation subsequent to the print-scan operation of interest so as to eliminate the difference calculated by the difference calculation unit.

4. The apparatus according to claim 1, wherein the generator corrects a dot formation position of each print-scan operation on the basis of the printing state detected by the detector.

5. The apparatus according to claim 1, wherein the generator corrects a print density ratio of each print-scan operation for each nozzle on the basis of the printing state detected by the detector.

6. An image forming apparatus which forms a halftone image on a print medium using multipass processing of reciprocally scanning a single area on the print medium by a printhead a plurality of number of times, forming dots on the print medium in one of reciprocal scan operations, and moving the printhead to a home position in the other reciprocal scan operation, the apparatus comprising:

generator configured to generate print data of each print-scan operation;

printing unit configured to print the halftone image on the print medium on the basis of the print data generated by the generator; and detector, in at least one print-scan operation out of a plurality of print-scan operations, detecting a state of printing on the print medium by the printing unit in up to a print-scan operation of interest, wherein the generator corrects the print data in synchronism with printing by the printing unit on the basis of the printing state detected by the detector.

7. The apparatus according to claim 6, wherein the detector includes a sensor which is arranged at a position subsequent to the printhead in a direction in which the print-scan operation is performed, and detects the printing state, and the sensor moves in synchronism with the printing unit.

8. The apparatus according to claim 6, further comprising:

cumulative density calculation unit, in at least one print-scan operation out of the plurality of print-scan operations, configured to calculate a cumulative density to print on the print medium in up to the print-scan operation; and difference calculation unit configured to calculate a difference between the cumulative density calculated by the cumulative density calculation unit and a density detected by the detector, wherein the generator corrects the print data of a print-scan operation subsequent to the print-scan operation of interest so as to eliminate the difference calculated by the difference calculation unit.

9. An image forming method of forming a halftone image on a print medium using multipass processing of reciprocally scanning a single area on the print medium by a printhead a plurality of number of times, forming dots on the print medium in one of reciprocal scan operations, and moving the printhead to a home position in the other reciprocal scan operation, the method comprising:

generating print data of each print-scan operation;

printing the halftone image on the print medium on the basis of the generated print data; and in at least one print-scan operation out of a plurality of print-scan operations, detecting a state of printing on the print medium in up to a print-scan operation immediately preceding a print-scan operation of interest, wherein the print data is corrected in synchronism with printing based on the detected printing state.

10. An image forming method of forming a halftone image on a print medium using multipass processing of reciprocally scanning a single area on the print medium by a printhead a plurality of number of times, forming dots on the print medium in one of reciprocal scan operations, and moving the printhead to a home position in the other reciprocal scan operation, the method comprising:

generating print data of each print-scan operation;

printing the halftone image on the print medium on the basis of the generated print data; and in at least one print-scan operation out of a plurality of print-scan operations, detecting a state of printing on the print medium in up to a print-scan operation of interest, wherein the print data is corrected in synchronism with printing based on the detected printing state.

11. A computer-readable storage medium storing a computer program which is read and executed by a computer to cause the computer to execute steps defined in claim 10.

* * * * *